US008134758B2

(12) United States Patent
Nakaishi et al.

(10) Patent No.: US 8,134,758 B2
(45) Date of Patent: Mar. 13, 2012

(54) IMAGE READING APPARATUS, IMAGE FORMING APPARATUS, IMAGE FORMING SYSTEM THAT EMPLOYS THE IMAGE READING APPARATUS AND THE IMAGE FORMING APPARATUS

(75) Inventors: Yoshiaki Nakaishi, Tokyo (JP); Hidenori Ueda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 866 days.

(21) Appl. No.: 12/219,890

(22) Filed: Jul. 30, 2008

(65) Prior Publication Data

US 2009/0040570 A1 Feb. 12, 2009

(30) Foreign Application Priority Data

Aug. 9, 2007 (JP) ..... 2007-208049
Feb. 1, 2008 (JP) ..... 2008-022883

(51) Int. Cl.
*N04H 1/04* (2006.01)

(52) U.S. Cl. ..... 358/474; 358/497; 358/486; 358/496; 399/401; 399/262; 271/3.01; 271/4.1

(58) Field of Classification Search ..... 358/474, 358/497, 496, 486, 498, 505, 401, 408; 399/401, 399/262, 406, 320; 271/3.01, 1.01, 4.1
See application file for complete search history.

(56) References Cited

U.S. PATENT DOCUMENTS 5,323,219 A 6/1994 Hamanaka et al.
5,416,611 A * 5/1995 Tandon ..... 358/474
5,448,340 A 9/1995 Ogiri et al.
5,546,168 A 8/1996 Adachi et al.
5,912,747 A * 6/1999 Murakami ..... 358/497
5,933,222 A * 8/1999 Hoshino et al. ..... 355/75
6,101,333 A * 8/2000 Bullitt et al. ..... 396/61
6,151,478 A * 11/2000 Katsuta et al. ..... 399/372
6,661,540 B1 * 12/2003 Hasegawa et al. ..... 358/474
7,123,390 B2 * 10/2006 Sato ..... 358/505
7,218,426 B2 * 5/2007 Sugano ..... 358/475
7,379,700 B2 * 5/2008 Iwata ..... 399/367
7,639,404 B2 * 12/2009 Ikeno et al. ..... 358/461
7,957,042 B2 * 6/2011 Onodera ..... 358/498

(Continued)

FOREIGN PATENT DOCUMENTS

JP 1-311762 12/1989

(Continued)

*Primary Examiner* — Negussie Worku
(74) *Attorney, Agent, or Firm* — Rabin & Berdo, PC

(57) ABSTRACT

An image reading apparatus reads an image of a document. An image reading section reads an image of a document. A scanning mechanism causes the image reading section to move relative to the document when the document is at rest. When the image reading section is at rest, a document feeding mechanism causes the document to move relative to the image reading section. A shutter moves to a first position where the shutter opens, allowing the image reading section to read the image of the document when the document moves relative to the image reading section at rest. The shutter moves to a second position where the shutter closes, allowing the image reading section to read the image of the document when the image reading section moves relative to the document at rest.

10 Claims, 20 Drawing Sheets

U.S. PATENT DOCUMENTS

2004/0140606 A1* 7/2004 Kobayashi et al. ..... 271/4.01
2004/0165227 A1* 8/2004 Makino et al. ..... 358/474
2005/0024692 A1* 2/2005 Shyu ..... 358/474
2005/0035524 A1* 2/2005 Fukumura et al. ..... 271/4.1
2005/0087920 A1* 4/2005 Takamatsu ..... 271/10.01
2005/0195451 A1* 9/2005 Sugano ..... 358/498
2007/0183004 A1* 8/2007 Jo ..... 358/498

FOREIGN PATENT DOCUMENTS

JP 6-46219 2/1994
JP 2001-242670 9/2001
JP 2007-336278 12/2007

* cited by examiner

IMAGE READING APPARATUS, IMAGE FORMING APPARATUS, IMAGE FORMING SYSTEM THAT EMPLOYS THE IMAGE READING APPARATUS AND THE IMAGE FORMING APPARATUS

BACKGROUND OF THE INVENTION

1. Field of the Invention

The present invention relates to an image reading apparatus, an image forming apparatus, and an image forming system that employs the image reading apparatus and the image forming apparatus.

2. Description of the Related Art

A conventional image forming apparatus such as a copying machine, a facsimile machine, and a multi function printer (MFP) is equipped with an image reading apparatus for reading the image of a document. The image reading apparatus includes an automatic document feeder (ADF) and a scanner. The ADF advances a plurality of pages of document to the scanner on a page-by-page basis. The scanner reads the image of each page of document fed by the ADF.

The scanner includes an image-reading sensor. The image-reading sensor reads the image of the document fed by the ADF as well as the image of a document placed on a flatbed. For reading the image of the document placed on the flatbed, the document must be pressed against the flatbed by a flatboard. For this reason, the image-reading sensor must be positioned outside of an image reading area on the flatbed when the image of the document fed by the ADF is read.

The conventional image reading apparatus of the aforementioned configuration suffers from a problem in that the image-reading sensor disposed outside of the image reading area increases the overall size of the image reading apparatus.

SUMMARY OF THE INVENTION

An object of the present invention is to solve the problems of the aforementioned conventional apparatus.

Another object of the invention is to provide an image reading apparatus and an image forming apparatus in which a shutter is disposed such that the shutter may be opened or closed relative to an image-reading section, thereby positioning the image-reading section at the image-reading area so that the overall size of the image reading apparatus may be small.

An image reading apparatus reads an image of a document. An image reading section reads an image of a document. A scanning mechanism causes the image reading section to move relative to the document when the document is at rest. When the image reading section is at rest, a document feeding mechanism causes the document to move relative to the image reading section. A shutter moves to a first position where the shutter opens, allowing the image reading section to read the image of the document when the document moves relative to the image reading section at rest. The shutter moves to a second position where the shutter closes, allowing the image reading section to read the image of the document when the image reading section moves relative to the document at rest.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Embodiments of the invention will be described with reference to the drawings.

First Embodiment

{Overall Configuration}

Figure 1:
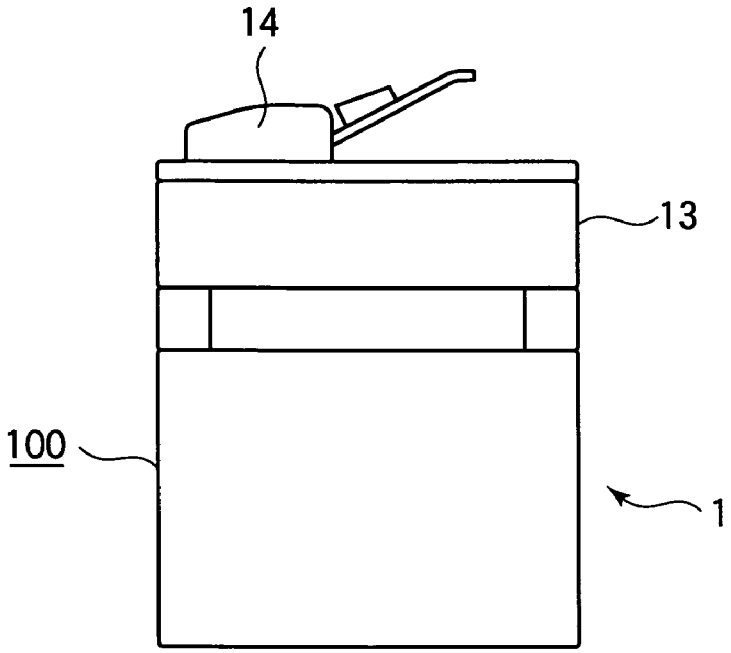
FIG. 1 is a front view of an image forming system.
Figure 2:
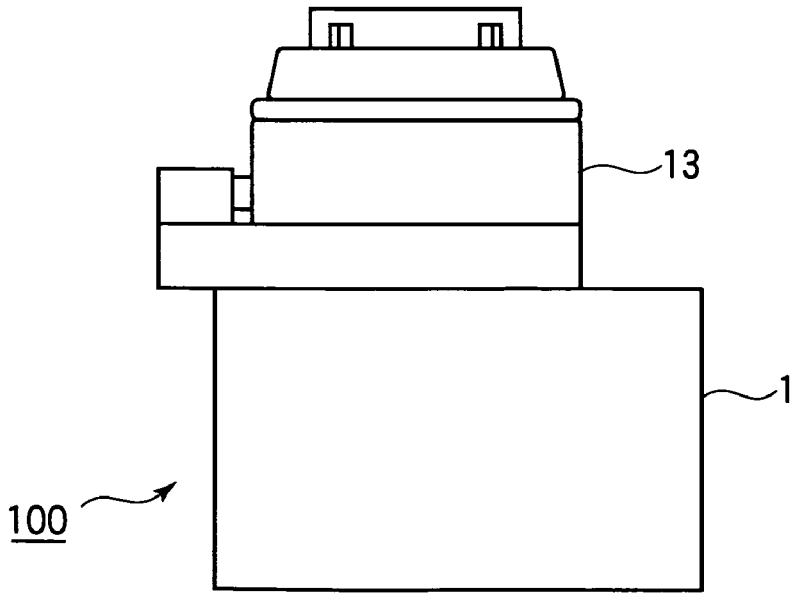
FIG. 2 is a left side view of the image forming system.

FIG. 1 is a front view of an image forming system 100. FIG. 2 is a left side view of the image forming system 100.

Figure 3:
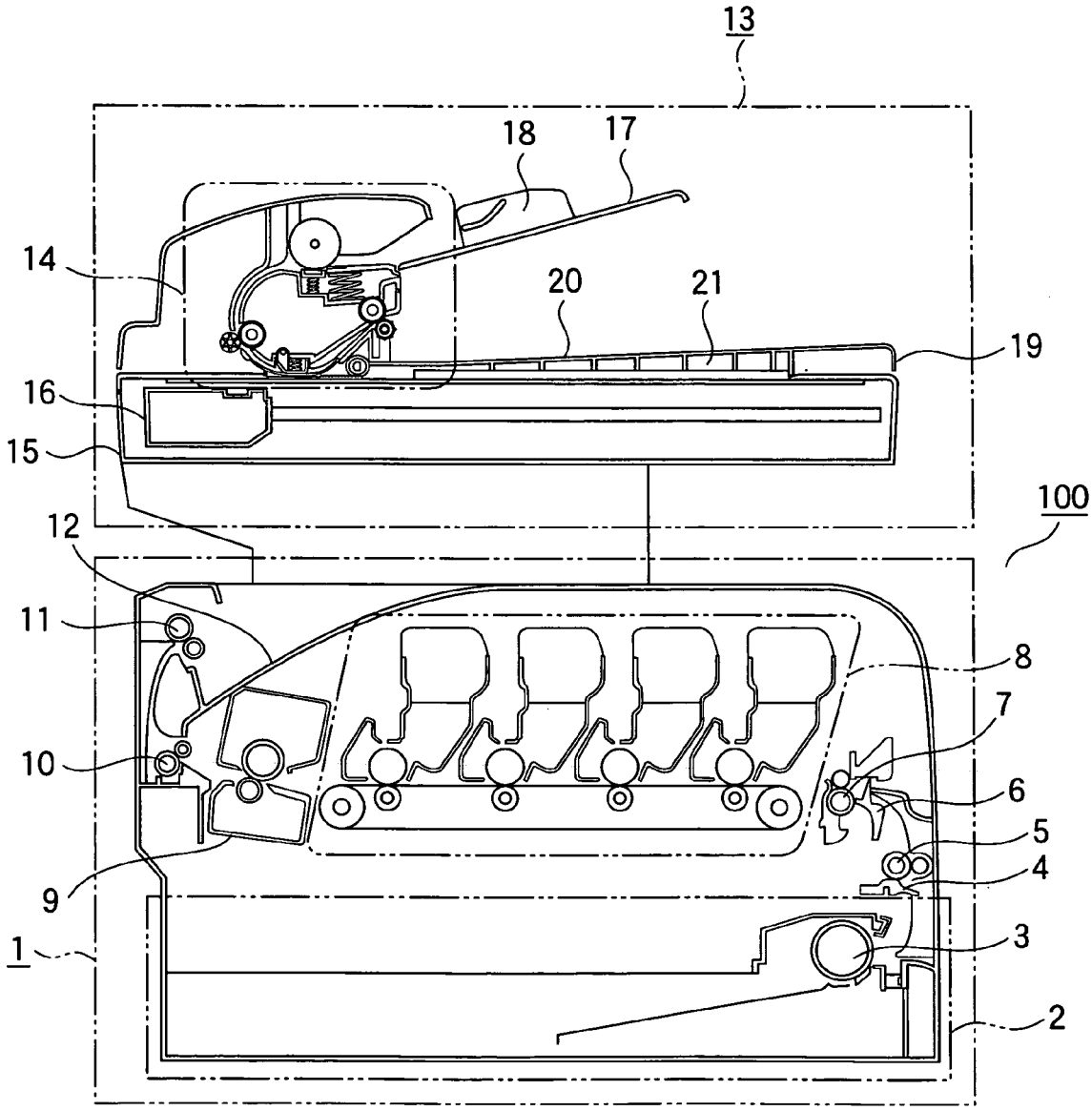
FIG. 3 illustrates the configuration of an image forming apparatus of a first embodiment.

FIG. 3 illustrates the configuration of an image forming system of a first embodiment.

Referring to FIG. 3, the image forming system 100 includes an image forming apparatus 1 and an image reading apparatus 13 disposed on the image forming apparatus 1. The image forming system takes the form of, for example, a multi function printer (MFP) such as a copying machine or a facsimile machine. The image forming system 100 may take any other form of apparatus, provided that the image forming system 100 includes the image reading apparatus 13 for reading the image of a document (e.g. printed paper) and the image forming apparatus 1 for printing the image on a print medium such as paper.

The image forming apparatus 1 may be either a monochrome printer or a color printer. The image forming apparatus 1 may also be of an ink jet type, a thermal printing type, or any other type. The image forming apparatus 1 includes four image drum units that form yellow (y), magenta (M), cyan (C), and black (K) images, respectively. The embodiment will be described with respect to a tandem type color electrophotographic printer that employs an electrophotographic process to form images.

An image forming unit 8 includes four image drum units that form toner images of corresponding colors, and that transfer the toner images onto a print medium. A fixing section 9 fixes the toner images that have been transferred onto the print medium. A paper cassette 2 holds a stack of print medium therein, and feeds the print medium on a page-by-page basis to the image forming unit 8.

The paper cassette 2 includes a feed roller 3 that feeds the print medium on a page-by-page basis into a medium transport path. The feed roller 3 includes a one-way clutch (not shown). When the clutch rotates in one direction, a drive force is transmitted through the clutch. When the clutch rotates in the other direction, the clutch rotates in an idling manner such that no drive force is transmitted through the clutch.

Sensors 4 and 6 are disposed along the medium transport path in which the print medium is transported from the paper cassette 2 to the image forming unit 8. A transport roller 5 corrects the skew of the print medium, fed from the paper cassette 2, before the print medium is fed into the image forming unit 8. A transport roller 7 causes the print medium, fed by the transport roller 5, to advance into the image forming unit 8.

The image forming unit 8 includes a plurality of image drum units each of which performs charging, exposing, developing, and transferring processes for images of corresponding colors. Toner images of the respective colors are transferred onto the print medium one over the other in registration as the print medium passes through the image drum units. The print medium carrying the toner images thereon passes through a fixing point defined between a heat roller and a pressure roller of the fixing section 9, where the toner images of the respective colors are fused into a full-color image.

Discharge rollers 10 and 11 are disposed along the medium transport path in which the print medium discharged from the fixing section 9 is transported. The discharge roller 11 discharges the print medium onto a discharge tray 12.

The image reading apparatus 13 is disposed on the image forming apparatus 1, and includes a document-feeding tray 17, a document feeding section 14, the discharge tray 19, and a flatbed scanner 15. The document feeding section 14 is hingedly coupled to the flatbed scanner 15 such that the document feeding section 14 may be pivoted relative to the flatbed scanner 15. When the document feeding section 14 is pivoted away from the flatbed scanner 15, a user is allowed to place a document on a flatbed 20 of the flatbed scanner 15 for manually feeing the document. When the document feeding section 14 is pivoted toward the flatbed scanner 15, the user is not allowed to place a document on the flatbed 20 but is allowed to place the document on the document feeding tray 17 for automatically feeding the pages of the document. The document feeding tray 17 supports pages of document thereon, and includes guides 18 that extend in directions substantially parallel to a direction of travel of the document and oppositely provided with the pages of document therebetween. The guides 18 guide the pages of document placed on the document-feeding tray 17 into the image reading apparatus 13. The document feeding section 14 feeds the pages of document to an image reading position 62 (FIG. 4B) at which the image of the document is optically read through an aperture 16*a* by an image reading section 105. Every time the image of a page of document has been read, the page is discharged onto the discharge tray 19.

{Construction of Image Reading Apparatus}

A description will be given of the configuration of the image reading apparatus 13.

Figure 4A:
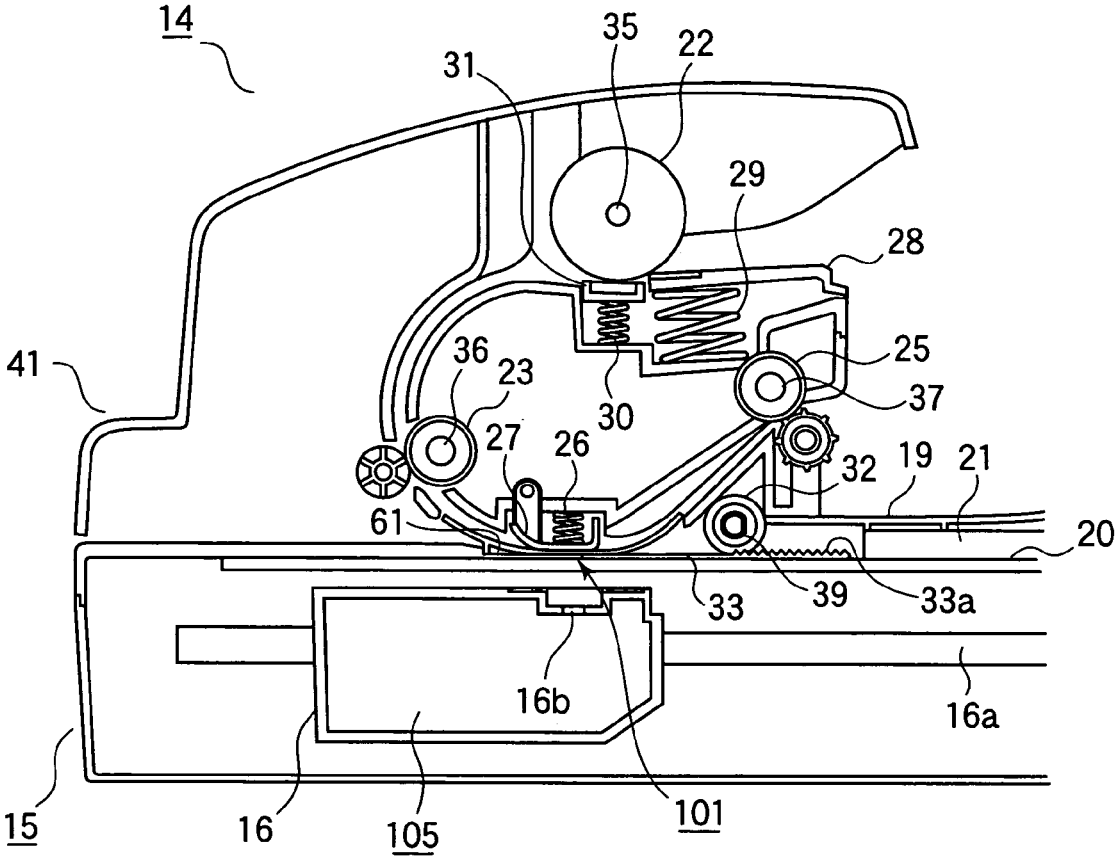
FIG. 4A is a first cross-sectional side view illustrating a pertinent portion of an image reading apparatus in an automatic mode.
Figure 4B:
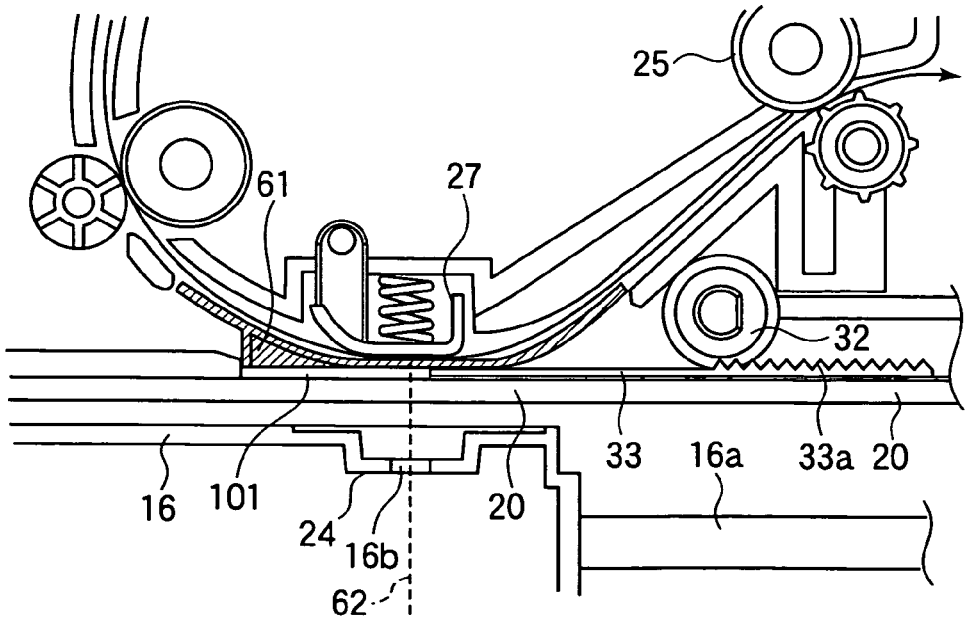
FIG. 4B is an expanded view of a pertinent portion of FIG. 4A.
Figure 5A:
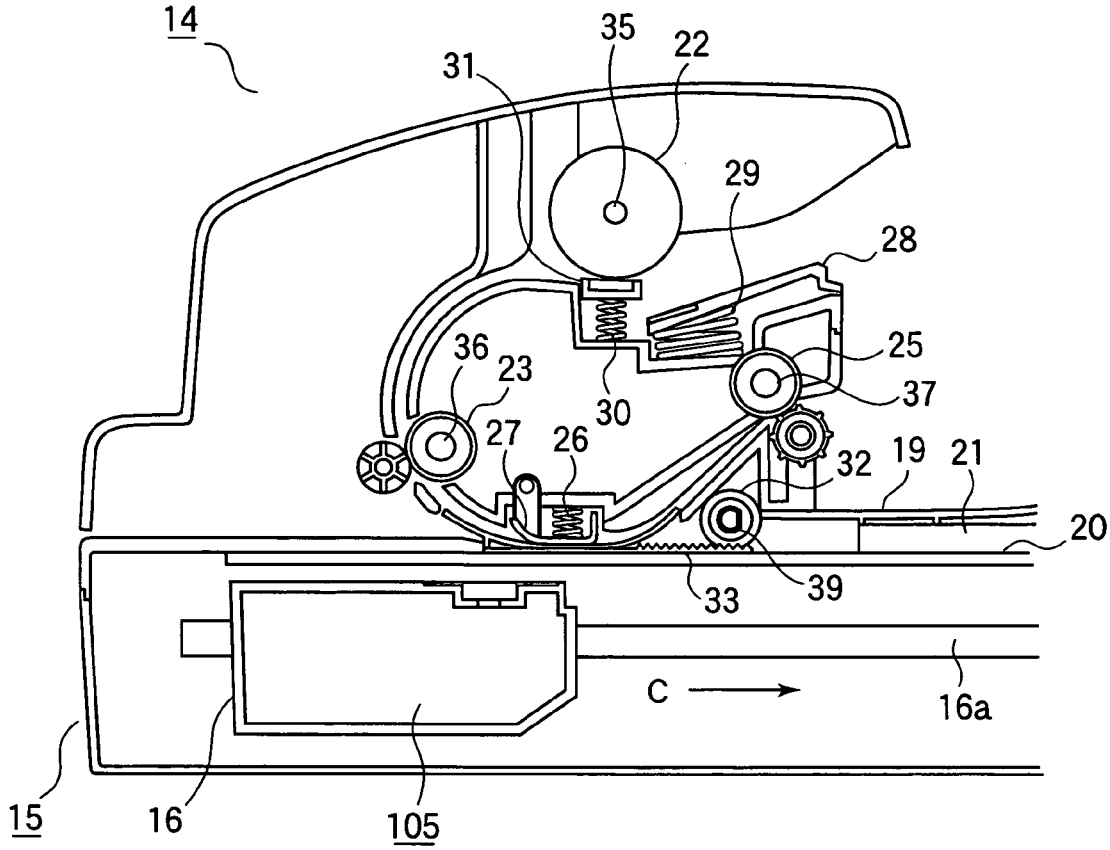
FIG. 5A is a second cross-sectional side view illustrating another pertinent portion of the image reading apparatus in a manual mode.
Figure 5B:
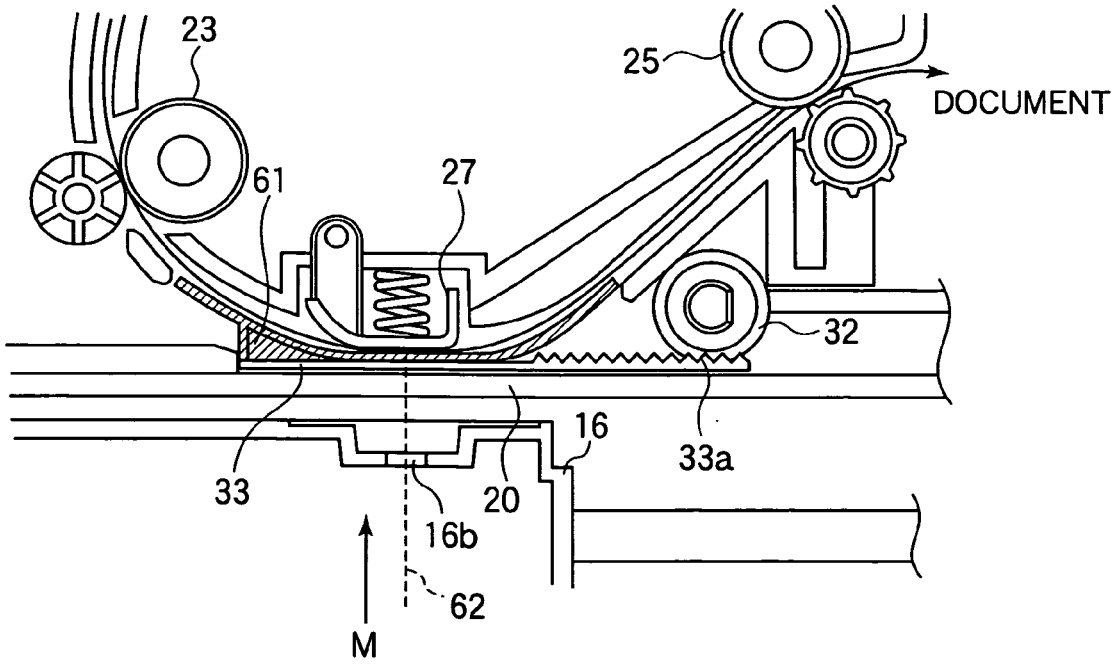
FIG. 5B is an expanded view of a pertinent portion of FIG. 5A.
Figure 5C:
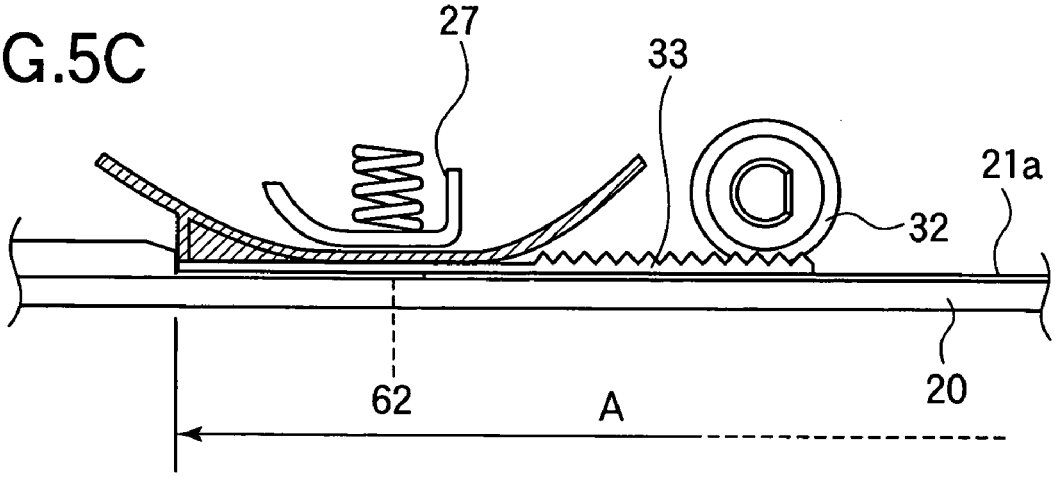
FIG. 5C is a partial expanded view illustrating the position of the shutter in the manual mode.
Figure 5D:
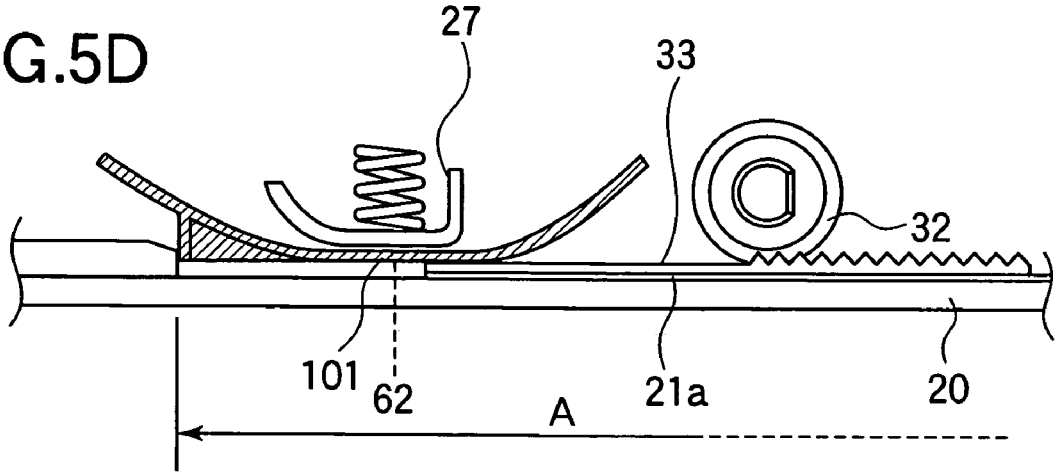
FIG. 5D is a partial expanded view illustrating the position of the shutter in the automatic mode.
Figure 6:
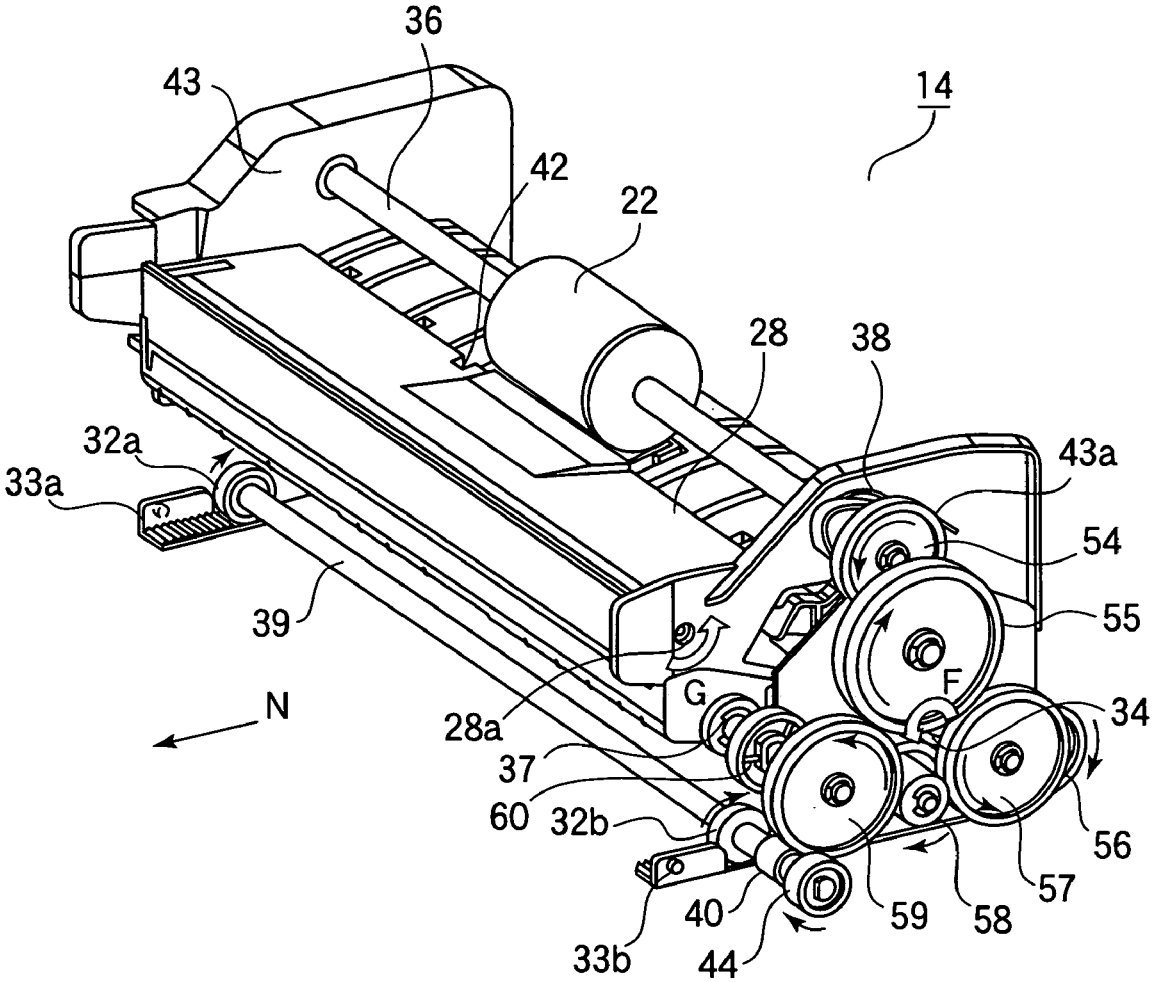
FIG. 6 is a perspective view illustrating the configuration of a driver section in the automatic mode.

FIG. 4A is a first cross-sectional side view illustrating a pertinent portion of the image reading apparatus 13 in a first mode or an automatic mode. FIG. 4B is an expanded view of a pertinent portion of FIG. 4A. FIG. 5A is a second cross-sectional side view illustrating another pertinent portion of the image reading apparatus 13 in a second mode or a manual mode. FIG. 5B is an expanded view of a pertinent portion of FIG. 5A. FIG. 5C is a partial expanded view illustrating the position of the shutter 33 in the manual mode. FIG. 5D is a partial expanded view illustrating the position of the shutter 33 in the automatic mode. FIG. 6 is a perspective view illustrating the configuration of the driver section in the automatic mode.

The document feeding section 14 is commonly referred to as an ADF, and feeds a page or pages of document to the image reading position 62 on a page-by-page basis in the automatic mode.

The flatbed scanner 15 is used for reading an image of a document placed on the flatbed 20 in the manual mode. The flatbed scanner 15 includes a document supporting plate or the flatbed 20, a document pressing plate 21, and a scanning mechanism or a carriage 16. The flatbed 20 is a plate-like member formed of a light transmitting material (e.g., glass) on which an image reading area A (FIG. 13) is defined. The user places a page of document in the image reading area A in the manual mode. The document pressing plate 21 has a lower surface to which a reflective white sheet 21*a* is attached. The white sheet 21*a* extends to cover the image reading area A except for a "window" 101 through which the image reading apparatus 105 read the image of the document in the automatic mode. The white sheet 21*a* may be larger than the image reading area A. The document pressing plate 21 presses the document placed in the image reading area on the flatbed 20, so that the white sheet 21*a* is in intimate contact with the document. The automatic mode and manual mode will be described later in more detail. The carriage 16 is under a lower surface of the flatbed 20 and reciprocally runs along the guide rail 16*a* in the manual mode.

The automatic mode is an operation mode of image reading apparatus 13 in which the document feeding section 14 feeds a page or pages of the document to the image reading area A where the image reading section 105 reads the image of the document. In the automatic mode, the carriage 16 remains at the image reading position 62 shown in FIGS. 4A and 4B, and the image reading section 105 reads the image of document.

The manual mode is an operation mode of image reading apparatus 13 in which a user manually places a page of the document placed on the flatbed 20 for the image of the document to be read by the image reading section 105. In the manual mode, the carriage 16 runs along the guide rail 16*a* relative to the flatbed 20 at a constant speed in a direction shown by arrow C as shown in FIG. 5A, and then returns in a direction opposite to the arrow C after reading one page of document.

Referring to FIGS. 4A and 6, a hopper 28 causes the leading edges of the pages of document supported on the document-feeding tray 17 to become even. The hopper 28 is configured to pivot about a shaft 28*a* (FIG. 6) between the FIG. 4A position and the FIG. 5A position, and is urged upward by a spring 29. A feed roller 22 feeds the pages of document into the image reading apparatus 13 on a page-by-page basis. A separator pad 31 is urged by a spring 30 against the feed roller 22, and cooperates with the feed roller 22 to separate the uppermost page from the stack of document. A transport roller 23 transports the pages of the document to the image reading point 62 on a page-by-page basis. A discharge roller 25 discharges each page of the document every time the image of that page has been read by the image reading section 105. A spring 26 urges a document pressing member or a paper weight 27 such that the paper weight 27 softly presses the document against a transparent guide 61 while allowing the page of the document to pass through the image reading position 62. The document advances face down through the image reading position 62 with the image side of the document sliding on the transparent guide 61. The paper weight 27 extends in a direction substantially perpendicular to the direction of travel of the document. The feed roller 22, transport roller 23, and discharging roller 25 rotate about drive shafts 35, 36, and 37, respectively. The transport roller 23, discharge roller 25, paper weight 27, and a colorless, transparent guide 61 constitute a document feeding mechanism.

The transparent guide 61 takes the form of a light transmitting acrylic plate, and therefore performs a function of the "window" 101 through which the image reading section 105 reads the image of the document in the automatic mode. The transparent guide 61 also performs a function of a guide that guides the document when the document passes through the image reading position 62 relative to the image reading section 105 in the automatic mode. The document feeding section 14 includes a plate-like shutter 33 configured to open and close the window 101. The shutter 33 moves to a first position or an opening position to open the window 101 in the automatic mode, allowing the image reading section 105 to read the image of the document through the window 101, and to a second position or a closing position to close the window 101 in the manual mode, not allowing the image reading section 105 to read the image of the document through the window 101. The shutter 33 is formed of a rigid material, and includes a rack 33*a* formed therein. The rack 33*a* meshes with a pinion gear 32 to constitute a rack-and-pinion mechanism. When the gear 32 rotates about a drive shaft 39, the shutter 33 is moved in a horizontal direction shown in FIGS. 4A-4B and 5A-5B.

The carriage 16 is generally box-shaped, and carries an image reading section 105 mounted thereon. The carriage 16 rides on a guide rail 16*a*, and is movable on the guide rail 16*a* in a horizontal direction.

Figure 7:
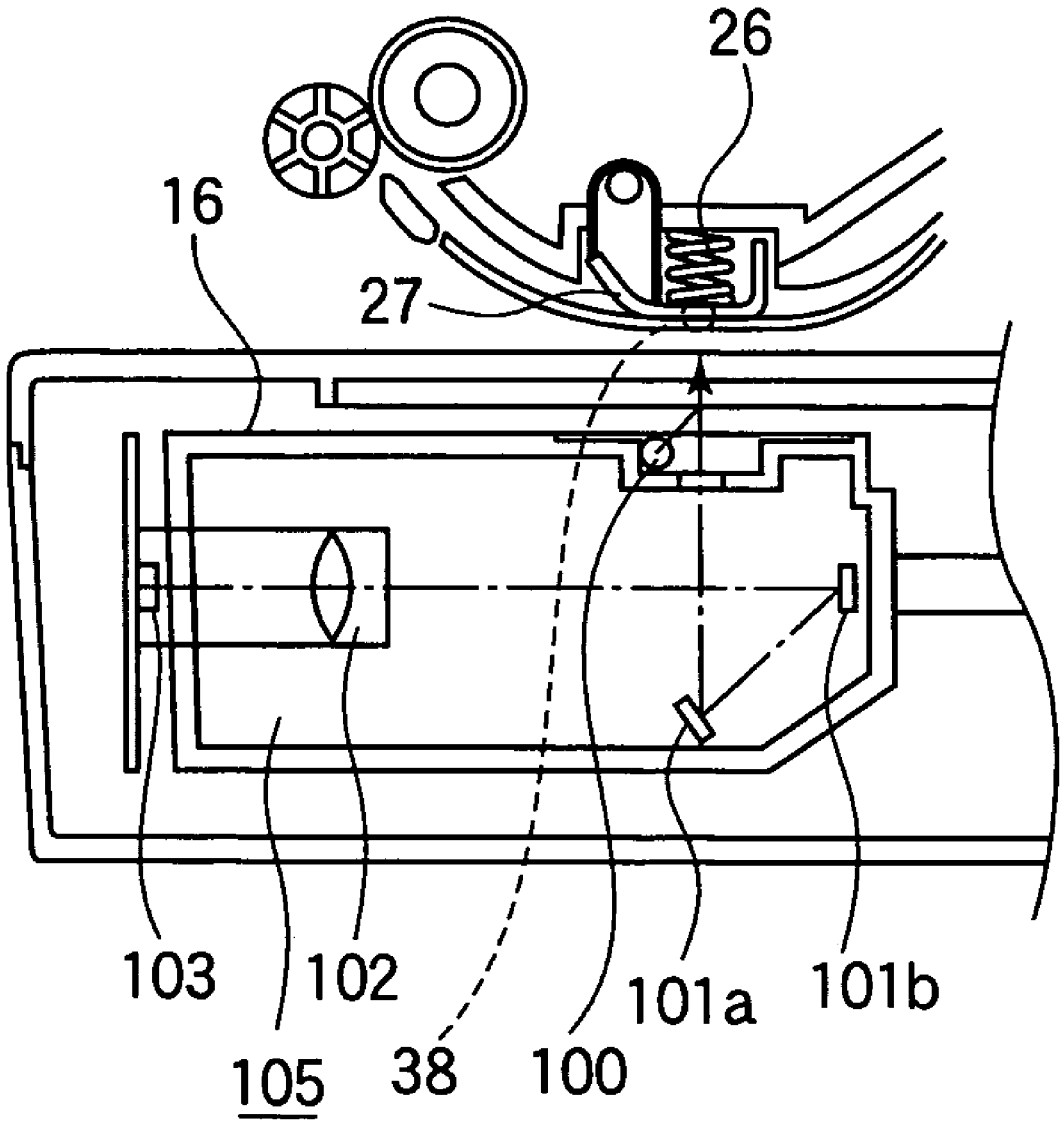
FIG. 7 illustrates the details of a carriage.

FIG. 7 illustrates the details of the carriage 16. The image reading section 105 mounted on the carriage 16 moves together with the carriage 16 in an advance direction (C direction in FIG. 5A) while scanning the image of the document in a transverse direction substantially perpendicular to the advance direction.

Referring to FIG. 7, a light source or a cold-cathode tube 100 emits light to the document. The electrode of the cold-cathode tube 100 should be a long life, low power dissipation electrode such as a molybdenum electrode, but may be any type of electrode. The light reflected by the document is incident on a mirror 101*a* and then on a mirror 101*b*. The image reading system 105 includes sensor elements 103 such as charge coupled devices (CCDs) or complementary metal oxide semiconductors (CMOSs), and optical elements such as a lens 102 and light guides such as mirrors 101*a* and 101*b*. The lens 102 focuses the light reflected by the mirror 101*b* on an image sensor 103. The image sensor 103 takes the form of a charge coupled device (CCD), and converts the received light into a digital signal.

In the automatic mode, the shutter 33 moves to open the window 101 (FIGS. 4A, 4B, and 5D). The carriage 16 remains at the image reading position 62, so that the image reading section 105 reads the document through the window 101. The image reading section 105 reads only a portion of the image of document that directly opposes the reading sensor 105 through the window 101. As the document moves past the window 101, the image reading section 105 reads the image of the document through the window 101. It is to be noted that the image reading position 62 is within the image reading area A (FIG. 13) defined on the flatbed 20 in which the reading sensor 105 moves to read the image of the document in the manual mode. The document is transported in a narrow path defined between the transparent guide 61 and the paper weight 27. The spring 26 urges the paper weight 27 downward such that the paper weight 27 presses the document against the transparent guide 61 while allowing the document to pass through the narrow path.

An opaque guide may be used in place of the transparent guide 61, in which case the window 101 may be a mere opening (e.g., slit) formed in the opaque guide. The opening should extend in a longitudinal direction substantially perpendicular to the direction of travel of the page of document, and have a length greater than the width of the document. The opening should have a width wide enough such that the image reading section 105 can read the image of the document through an aperture 16*a* when the document moves relative to the image reading section 105.

In the manual mode, the shutter 33 is moved leftward in the horizontal direction, completely closing the window 101 at the image reading position 62 as shown in FIGS. 5A, 5B, and 5C.

{Driver Section}

The driver section of the image reading apparatus 13 will be described.

FIG. 6 is a perspective view illustrating the configuration of the driver section in the automatic mode.

Figure 8:
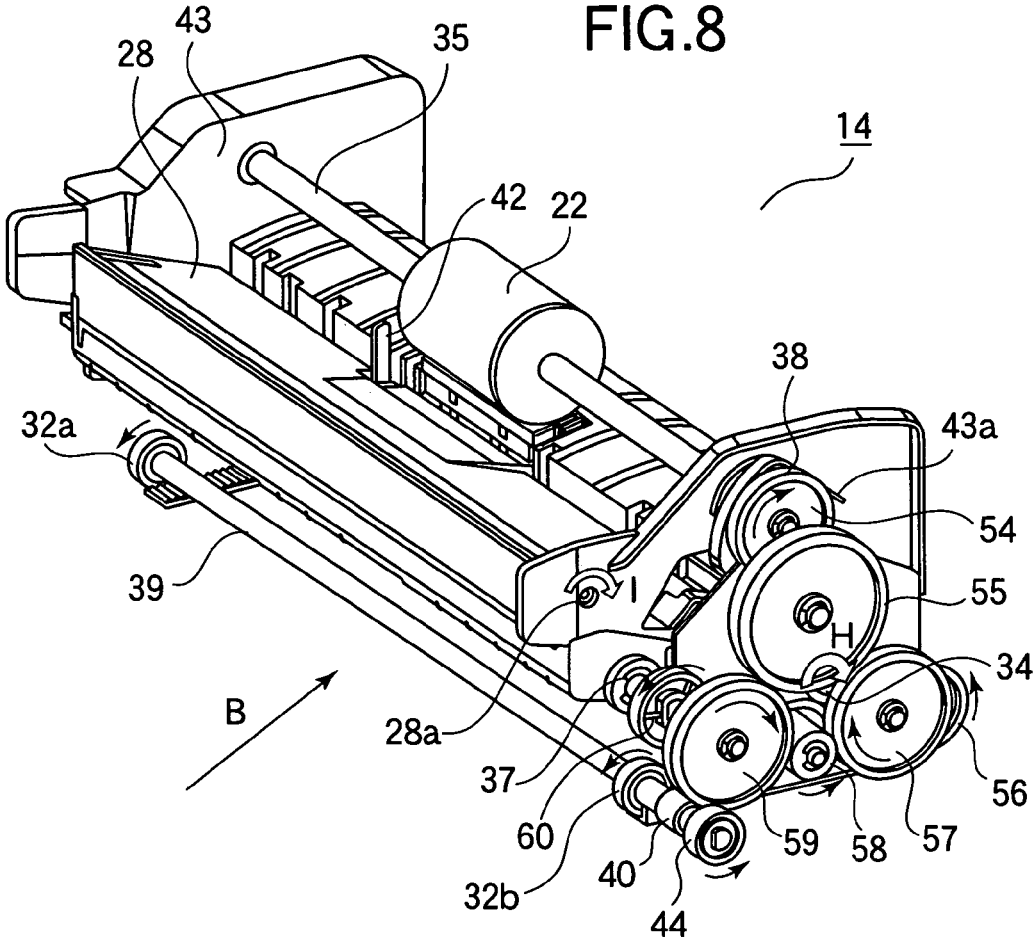
FIG. 8 is a perspective view illustrating the configuration of the driver section in the manual mode.

FIG. 8 is a perspective view illustrating the configuration of the driver section in the manual mode.

Figure 9:
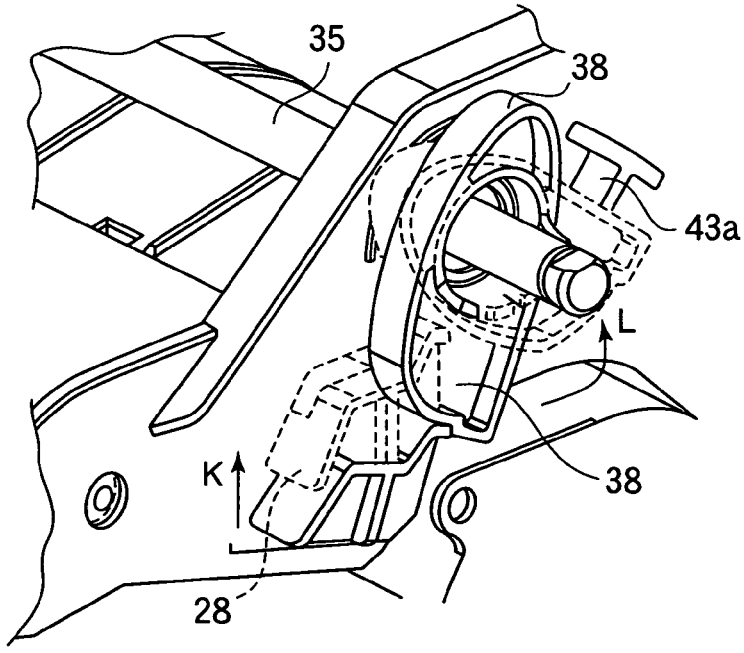
FIG. 9 illustrates the positional relation between a locking member and a hopper.

FIG. 9 illustrates the positional relation between a locking member 38 and the hopper 28.

Referring to FIGS. 6 and 8, the drive shafts 35, 36 (FIG. 4A), 37 (FIG. 4A), and 39 are mounted to a base frame 43 of the image reading apparatus 13. Gears for driving the shutter 33 includes a first gear 32*a* and a second gear 32*b*, which are disposed on opposite sides of a path of the document. The gears 32*a* and 32*b* are mounted to the drive shaft 39. A shaft 28*a* of the hopper 28 is also mounted to the base frame 43.

The image reading apparatus 13 includes a drive motor 34 that drives the drive shafts 35-37 and 39, the locking member 38 coupled to the drive shaft 35, a sensor 42 that detects the document on the hopper 28, a torque limiter 40 mounted to the drive shaft 39, a rib 43*a* (FIG. 9) formed on the base frame 43 that abuts the locking member 38, and gears 44 and 54-60.

When the user places a page(s) of document on the hopper 28, the document presses down the sensor 42, so that the sensor 42 detects the document. The gear 54 coupled to the drive shaft 35 drives the feed roller 22 and the locking member 38 in rotation (FIG. 9). A gear 56 coupled to a drive shaft 36 drives a transport roller 23 (FIG. 5A) in rotation. The gear 60 is coupled to the drive shaft 37 and drives the discharge roller 25 in rotation.

The gears 55-59 are of a double-gear type, and transmit the drive force of the drive motor 34 to the gears 54, 56, and 60. The gear 58 meshes with the gears 57 and 59. The gear 57 is in mesh with the gear 56. The gear 59 is in mesh with the gears 44, 55, and 60.

In the automatic mode where the document feeding section 14 feeds the document to the image reading position 62, the drive motor 34 rotates in a direction shown by hollow arrow F as shown in FIG. 6, and the shutter 33 (FIG. 12) moves in a direction shown by arrow N. The drive motor 34 drives the gear 54, which in turn causes the locking member 38 to rotate in a direction shown by arrow L (FIG. 9). Thus, the locking member 38 unlocks the hopper 28, allowing the hopper 28 to rotate about the shaft 28*a* in a direction shown by hollow arrow G (FIG. 6). The hopper 28 moves up in a direction shown by arrow K (FIG. 9).

In the manual mode where the user manually places the document placed on the flatbed 20, the drive motor 34 rotates in a direction shown by hollow arrow H shown in FIG. 8, so that the shutter 33 moves in the B direction. Because the locking member 38 locks the hopper 28, the hopper 28 rotates about the shaft 28*a* in a direction shown by hollow arrow I.

Figure 10A:
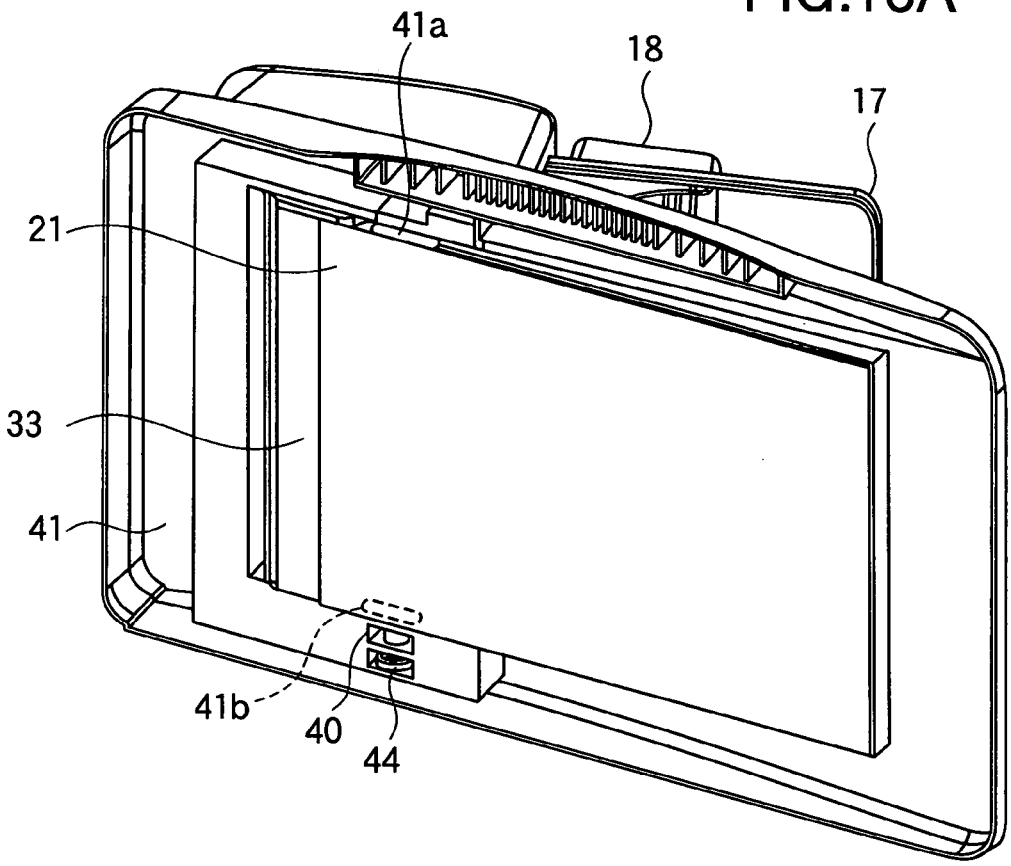
FIG. 10A is a perspective view illustrating the configuration of a document pressing plate for the image reading apparatus.

FIG. 10A is a perspective view illustrating the configuration of the document pressing plate 21 for the image reading apparatus 13.

Figure 10B:
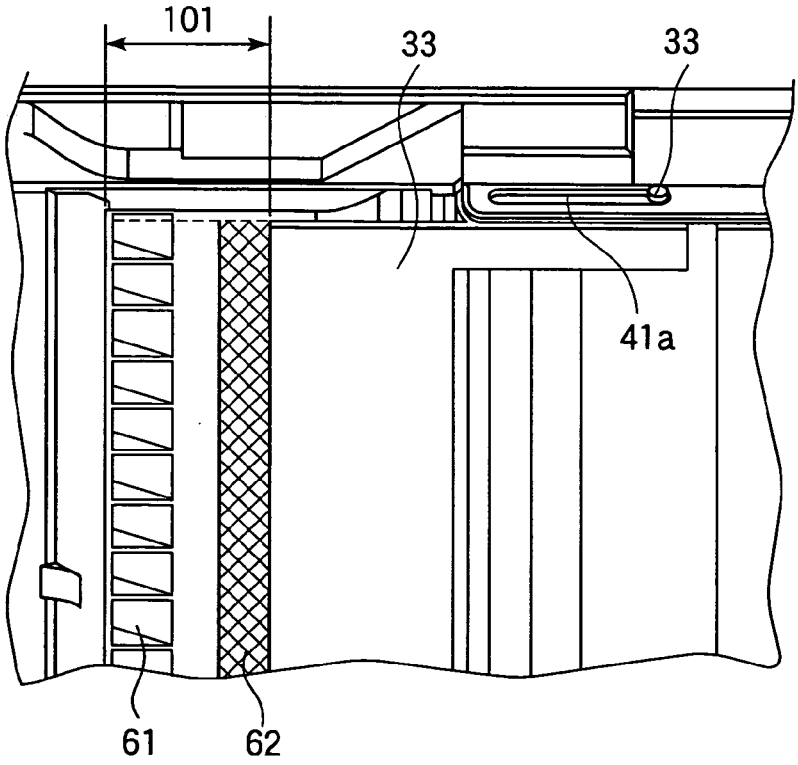
FIG. 10B illustrates a shutter as seen in a direction shown by arrow M shown in FIG. 5B when it opens a window.

FIG. 10B illustrates the shutter 33 as seen in a direction shown by arrow M shown in FIG. 5B when it opens the window 101.

Figure 11:
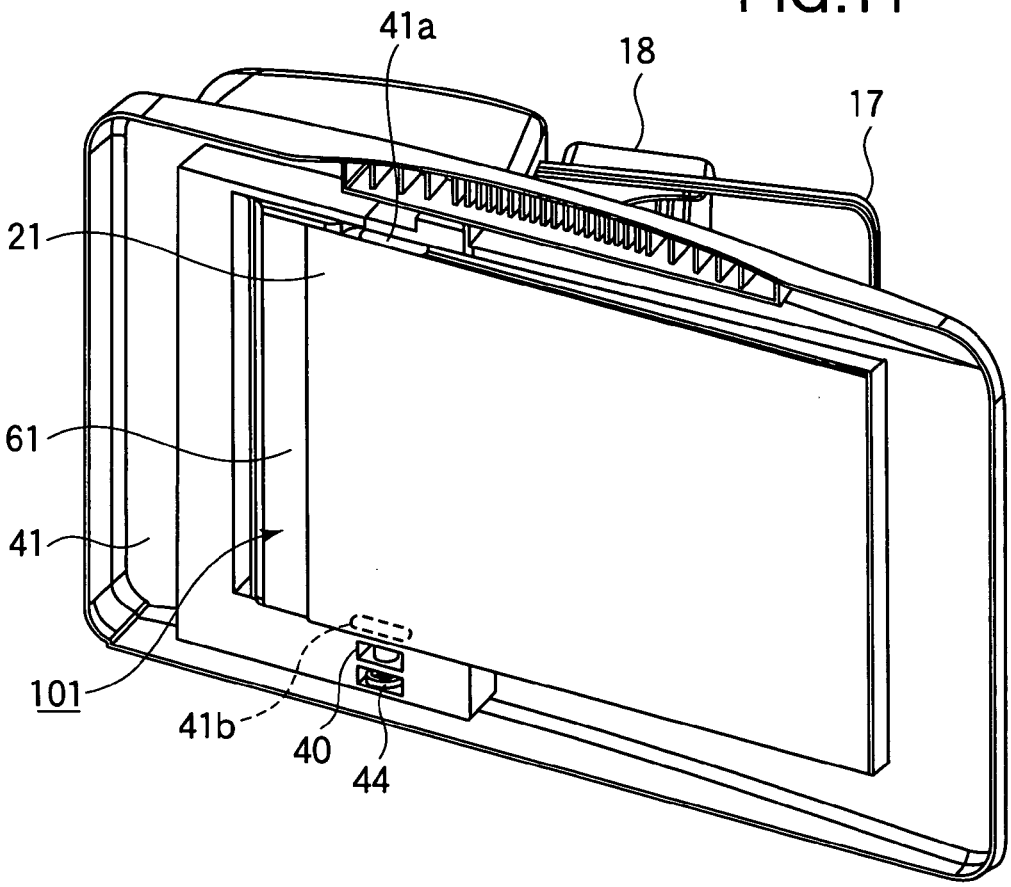
FIG. 11 is a perspective view illustrating the configuration of a document pressing plate.

FIG. 11 is a perspective view illustrating the configuration of the document pressing plate 21.

Figure 12:
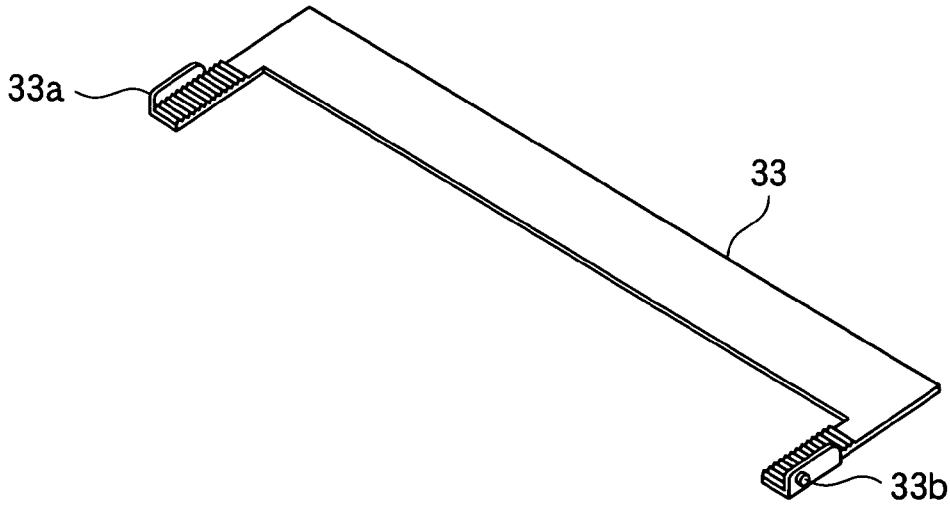
FIG. 12 is a perspective view illustrating a shutter.

FIG. 12 is a perspective view illustrating the shutter 33.

Referring to FIGS. 10A, 10B and 11, the image reading apparatus 13 includes a cover 41 that encloses the flatbed 20, and the document feeding mechanism constituted of the transport roller 23, discharge roller 25, paper weight 27, and transparent guide 61. The cover 41 includes elongated holes 41*a* and 41*b* formed therein at opposing locations. The shutter 33 includes posts 33*a* and 33*b* (FIG. 12) which loosely fit into the elongated holes 41*a* and 41*b*, respectively, so that the shutter 33 is slidable relative to the cover 41. The shutter 33 may take the form of either a white plastic plate or a plate-like member on which a reflecting white sheet is attached.

Referring back to FIGS. 6 and 8, when a torque larger than a predetermined value is exerted on the torque limiter 40, the torque limiter 40 allows the gear 44 to rotate in an idling manner, not transmitting the drive force from the gear 44 to the first and second gears 32*a* and 32*b*. The predetermined value of torque should be, for example, 300 g·cm, which is larger than that sufficient for opening and closing the shutter 33.

In the automatic mode, the shutter 33 is opened as shown in FIG. 10B and 11 to open the window 101. In the manual mode, the shutter 33 is closed as shown in FIG. 10A to close the window 101.

Figure 13:
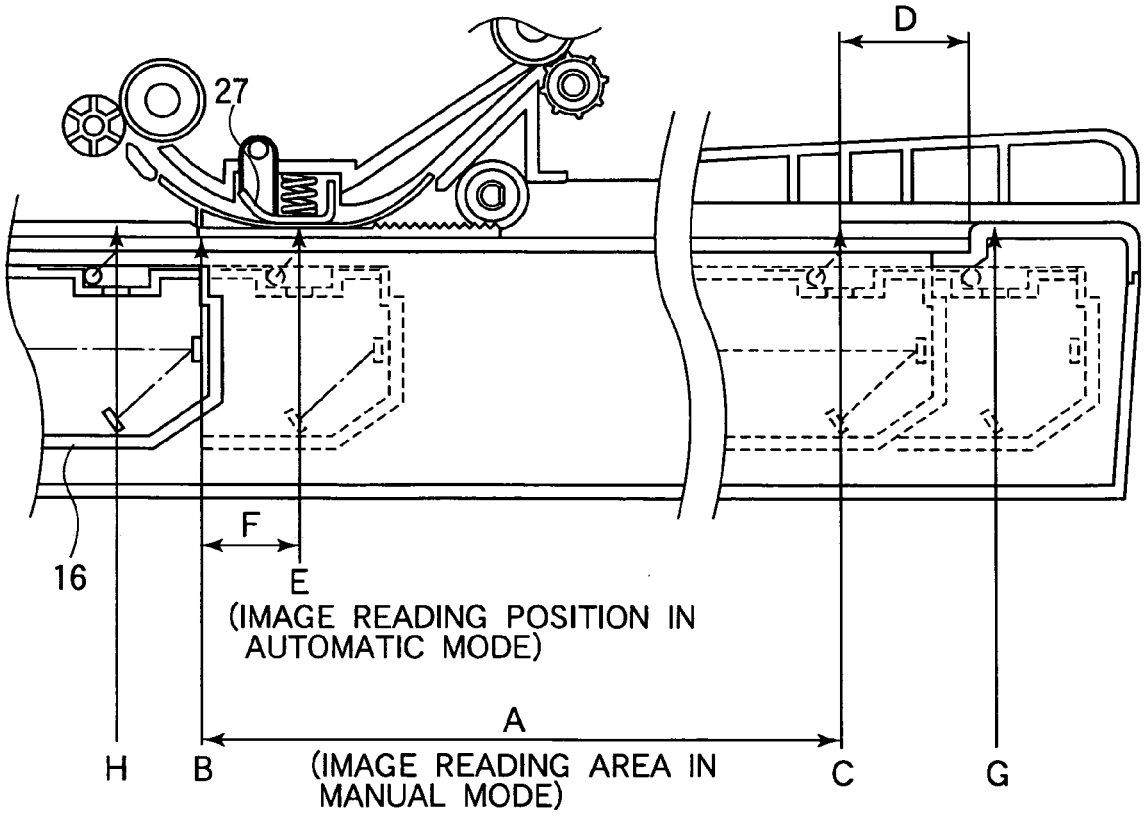
FIG. 13 illustrates various positions of a carriage within the flatbed scanner.

FIG. 13 illustrates various positions of the carriage 16 within the flatbed scanner 15. When an image reading operation is not activated, the carriage 16 is at position H, which is a home position. In the automatic mode, when the user depresses a start button for scanning or copying a document, the carriage 16 is moved from home position H to position E where the image reading section 105 reads the image of the document that passes over the reading position 62. In the manual mode, the image reading section 105 starts reading the image of the document at position B and stops the reading at position C. The carriage 16 slows down after passing position C and stops at position G. The distance D between position C and position G is longer than the distance F between position B and position E.

{Operation of Image Forming System}

{Operation of Image Forming Apparatus}

The operation of the image forming system 100 of the aforementioned configuration will be described. The operation of the image forming apparatus 1 will be first described.

The feed roller 3 feeds the print medium (e.g., paper) from the paper cassette 2 on a page-by-page basis. The print medium is transported by the transport rollers 5 and 7 to the image forming unit 8, which in turn transfers toner images of the respective colors onto the print medium. The print medium having the toner images thereon is then advanced to the fixing section 9. The print medium passes through the fixing point where the toner image is fused by heat and pressure into a full color image. Then, the print medium is discharged by the discharge rollers 10 and 11 onto the discharge tray 12. This completes the operation of the image forming apparatus 1.

{Operation of Image Reading Apparatus}

{Automatic Mode}

The operation of the image reading apparatus 13 will now be described. A description will be given of the operation of the image reading apparatus 13 in the automatic mode.

Figure 14:
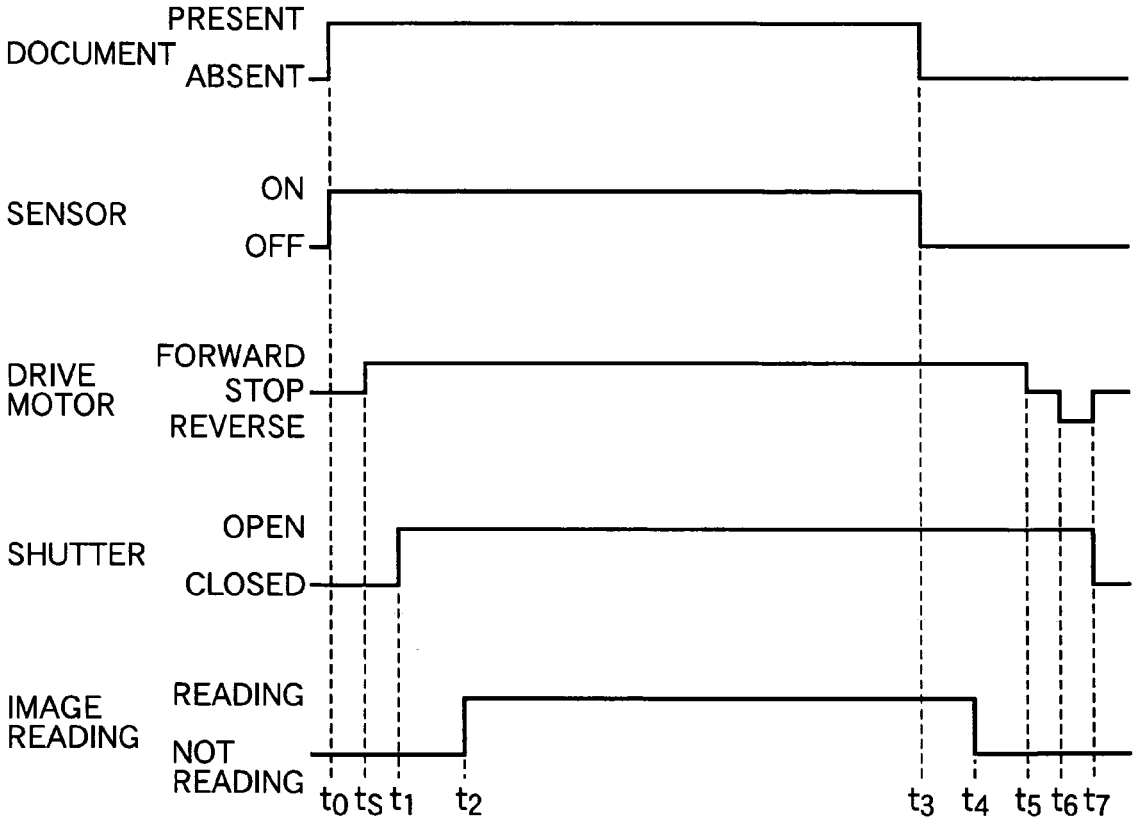
FIG. 14 is a timing chart illustrating the operation of the image reading apparatus.

FIG. 14 is a timing chart illustrating the operation of the image reading apparatus 13.

When the user places the document on the document-feeding tray 17, the document slides on the document-feeding tray 17 to the sensor 42 and presses the sensor 42 downward, so that the sensor 42 detects the document (time t0). Subsequently, the user depresses, for example, a start button (not shown) to command to read the image of the document (time ts). Then, the drive motor 34 rotates in a direction shown by hollow arrow F shown in FIG. 6. When the document is not placed on the document-feeding tray 17 (i.e., the sensor 42 does not detect the document), even if a command to read the document is issued by the user, it is determined that the document is not present on the hopper 28. Thus, the drive motor 34 does not rotate.

When the drive motor 34 rotates in the F direction (FIG. 6) the gears 44, 54-59, and 60 rotate in directions shown by arrows shown in FIG. 6. The locking member 38 coupled to the drive shaft 35 rotates in the same direction as the gear 54, and then abuts the rib 43*a* (FIG. 9) formed on the base frame 43 to stop. This causes the locking member 38 to disengage from the hopper 28, thereby unlocking the hopper 28.

Because the first gear 32*a* and second gear 32*b* mounted to the drive shaft 39 rotate at the same time as the locking member 38, the shutter 33 slides in the N direction shown in FIG. 6. When the posts 33*a* and 33*b* of the shutter 33 abut the longitudinal ends of the elongated holes 41*a* and 41*b* formed in the cover 41, respectively, a large load is exerted on the drive shaft 39 so that the shutter 33 becomes unable to move any further. As a result, the torque limiter 40 allows the gear 44 to rotate in an idling manner, the drive force being no longer transmitted from the gear 44 to the first gear 32*a* and second gear 32*b*. Thus, the first and second gears 32*a* and 32*b* stop rotating. This causes the shutter 33 to stop sliding, the shutter 33 opening the window 101 (time t1). Thus, the window 101 is exposed as shown in FIG. 11.

When the hopper 28 is unlocked, the urging force of the spring 29 causes the hopper 28 to pivot about the shaft 28*a* in a direction shown by hollow arrow G (FIG. 6), thereby allowing the document to contact the feeding roller 22 intimately. The feeding roller 22 feeds the document toward the transport roller 23 from the document-feeding tray 17 on a page-by-page basis. Subsequently, the transport roller 23 feeds the document to the image reading position 62 over the aperture 16*b* of the image reading senor 105 at rest as shown in FIG. 4A. Then, the image reading section 105 initiates reading of the image of the document (time t2). The paper weight 27 presses the document against the window 101 of the transparent guide 61 while allowing the document to pass through the image reading position 62.

After the image of the document has been read, the transport roller 25 discharges the document onto the discharge tray 19. In this manner, the document is fed from the document-feeding tray 17 to the image reading position 62 so that the image reading section 105 reads the image of the document (time t2 to time t4).

When all of the pages of the document have been fed from the document-feeding tray 17, the sensor 42 returns to the position shown in FIG. 8 (the sensor 42 protrudes upwardly), and the detection output of the sensor 42 becomes OFF (time t3).

When the final page of the document has passed the image reading position, the reading of the image of the document completes (time t4). Thereafter, the drive motor 34 is rotated for a predetermined time, and is then stopped when the final page of the document has been discharged (time t5).

Then, the drive motor 34 stops rotating for the predetermined time, and then the drive motor 34 rotates temporarily in the opposite direction shown by hollow arrow H (FIG. 8) under the control of the program (time t6). This causes the gears 44 and 54-59 and 60 to rotate in directions shown by arrows shown in FIG. 8. Then, the locking member 38 coupled to the drive shaft 35 rotates in the same direction as the gear 54, pushing down the hopper 28 such that the hopper 28 pivots about the shaft 28*a* in the direction shown by hollow arrow I. This locks the hopper 28.

The first gear 32*a* and second gear 32*b* fixed to the drive shaft 39 rotate at the same time as the locking member 38 rotates. As shown in FIG. 8, the shutter 33 slides in the B direction (FIG. 8) to close the window 101 of the transparent guide 61 as shown in FIG. 10A. Then, the drive motor 34 stops rotating (time t7)

{Manual Mode}

A description will be given of the operation of the image reading apparatus 13 in the manual mode.

In the manual mode, the document is placed on the flatbed 20 and therefore the sensor 42 does not detect the document. The shutter 33 remains at a position where the shutter 33 closes the window 101 as shown in FIGS. 5A, 8, and 10A.

When the user depresses, for example, a start button (not shown) to command to read the image of the document, the carriage 16 moves at a constant speed in a direction shown by arrow C shown in FIG. 5A. The image reading section 105 moves together with the carriage 16 while reading the image of the document placed on the flatbed 20.

The image data read by the image reading apparatus 13 is transferred to the image forming apparatus 1, and the image forming apparatus 1 initiates image formation.

As described above, in the automatic mode, the image reading section 105 remains at the image reading position 62 and reads the image of a document. In the manual mode, the image reading sensor 105 moves across the image reading area A defined on the flatbed 20. The image reading position 62 is within the image reading area A on the flatbed 20. As a result, the overall size of the image reading apparatus 13 may be small.

Additionally, the shutter 33 opens and closes in an interlocked relation with the drive motor 34. This simple mechanism provides uniform reflection of light from the image side of the document, ensuring that the image reading section 105 reads the image of the document accurately.

Modification to First Embodiment

Figure 15:
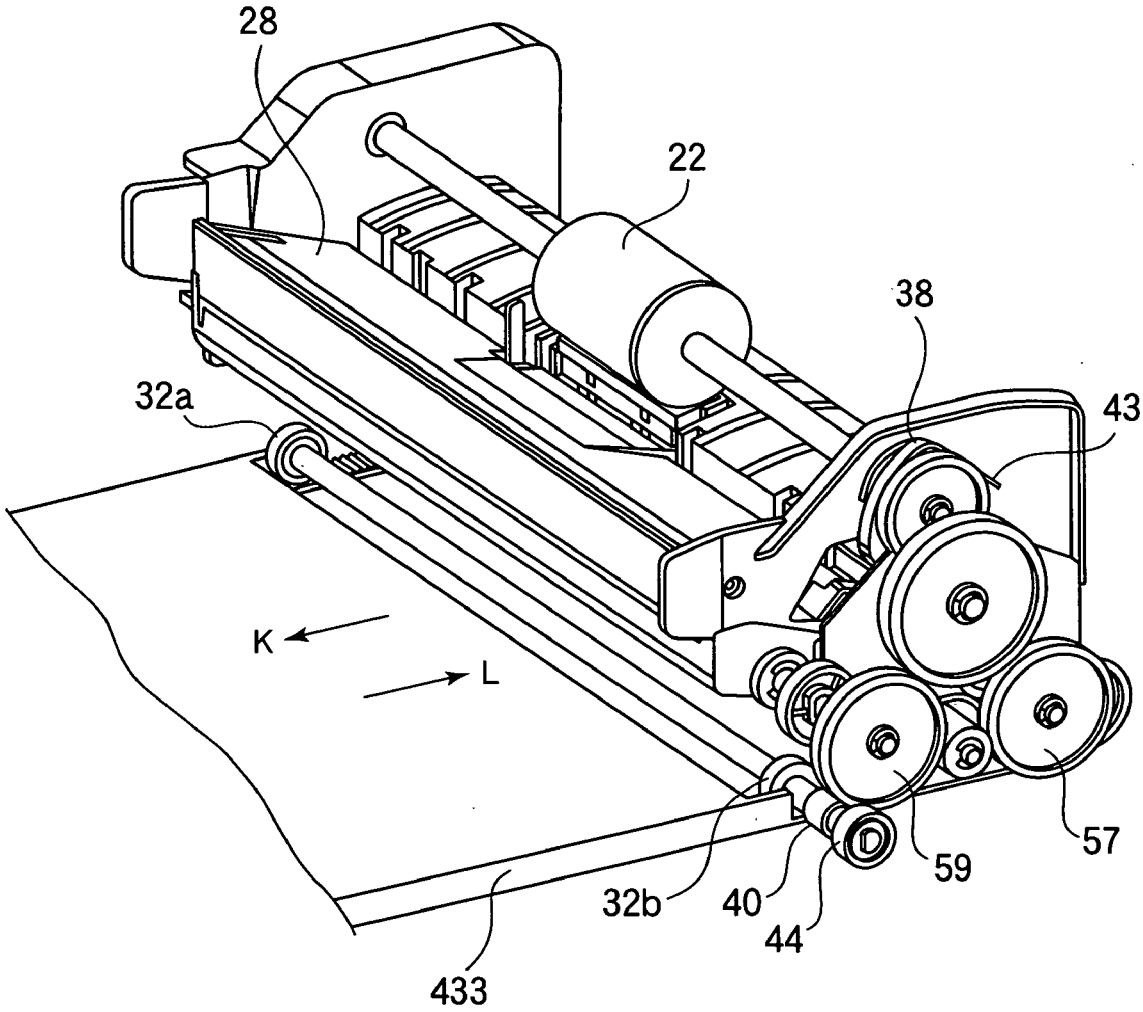
FIG. 15 illustrates a modification to the shutter 33.

FIG. 15 illustrates a modification to the shutter 33. The shutter 33 may be replaced by another shutter 433 as shown in FIG. 15. The shutter 433 is equivalent to a structure in which the shutter 33 and the document pressing plate 21 are in one piece. The shutter 433 moves in interlocked relation with the drive motor 34.

Second Embodiment

A document feeding section 14 of the second embodiment differs from that of the first embodiment in that a sheet-like shutter 46 is employed. Elements common to those of the first embodiment have been given the same reference numerals, and their description is omitted. The description of the same operations and advantages as the first embodiment is also omitted.

Figure 16A:
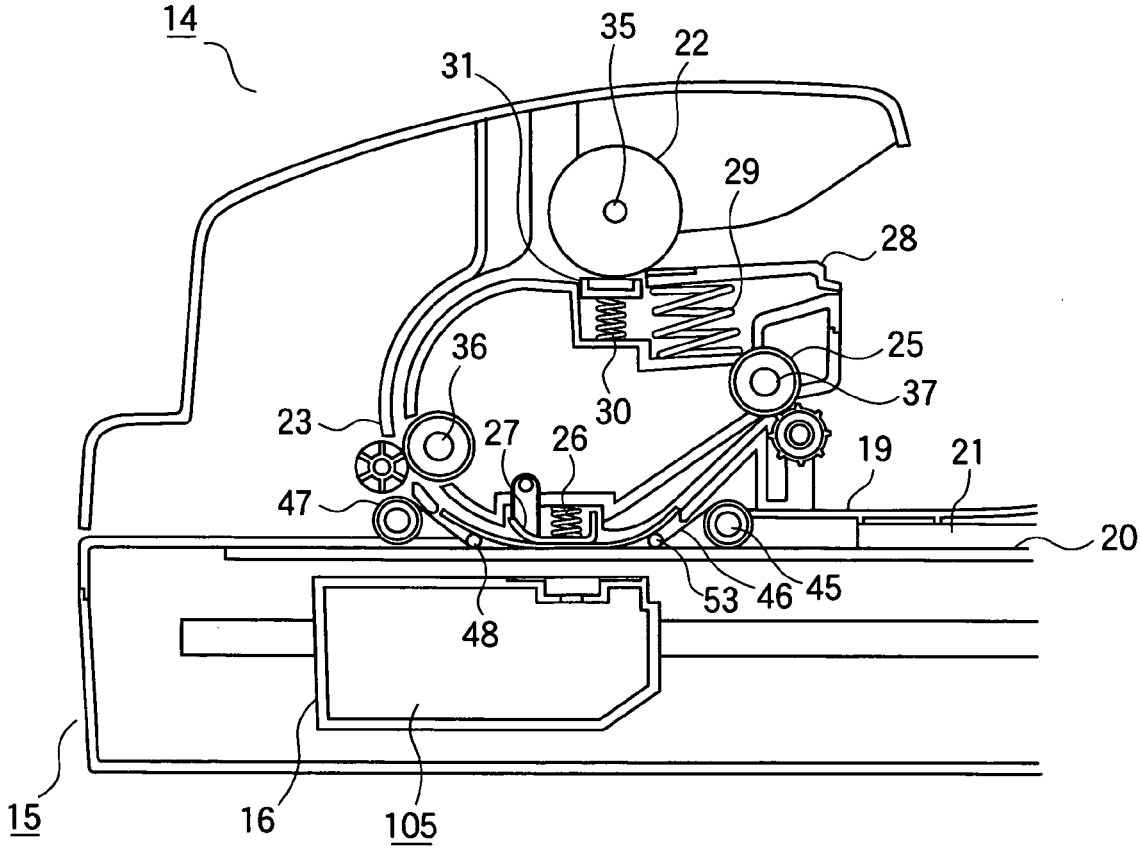
FIG. 16A is a cross sectional view illustrating the configuration of an image reading apparatus of a second embodiment.

FIG. 16A is a cross sectional view illustrating the configuration of an image reading apparatus 13 of a second embodiment.

Figure 16B:
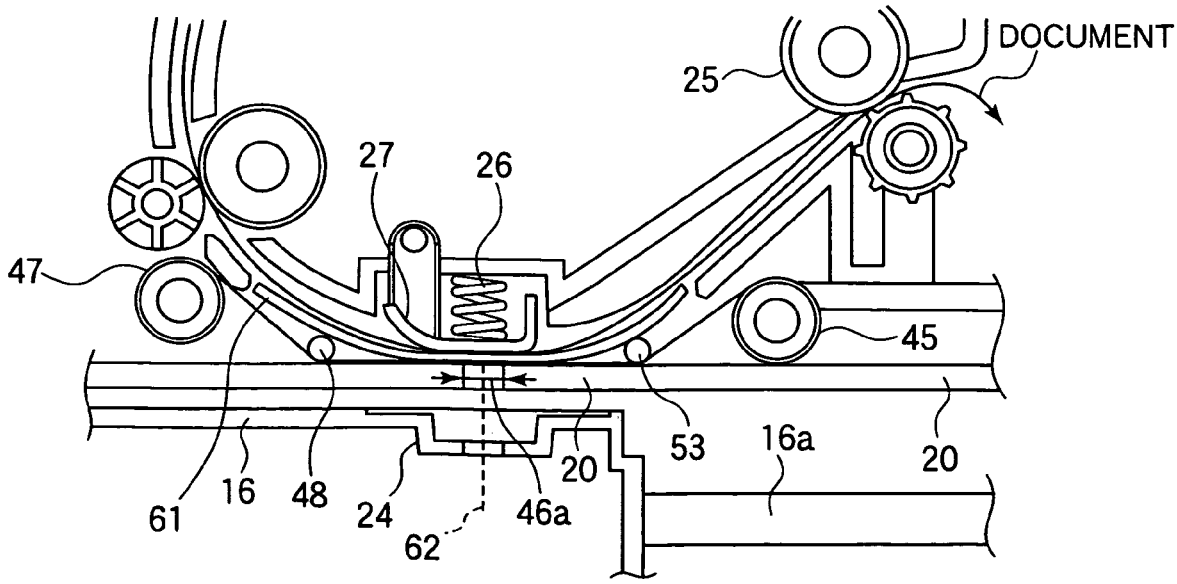
FIG. 16B is an expanded view of a pertinent portion of FIG. 16A.

FIG. 16B is an expanded view of a pertinent portion of FIG. 16A.

Figure 17:
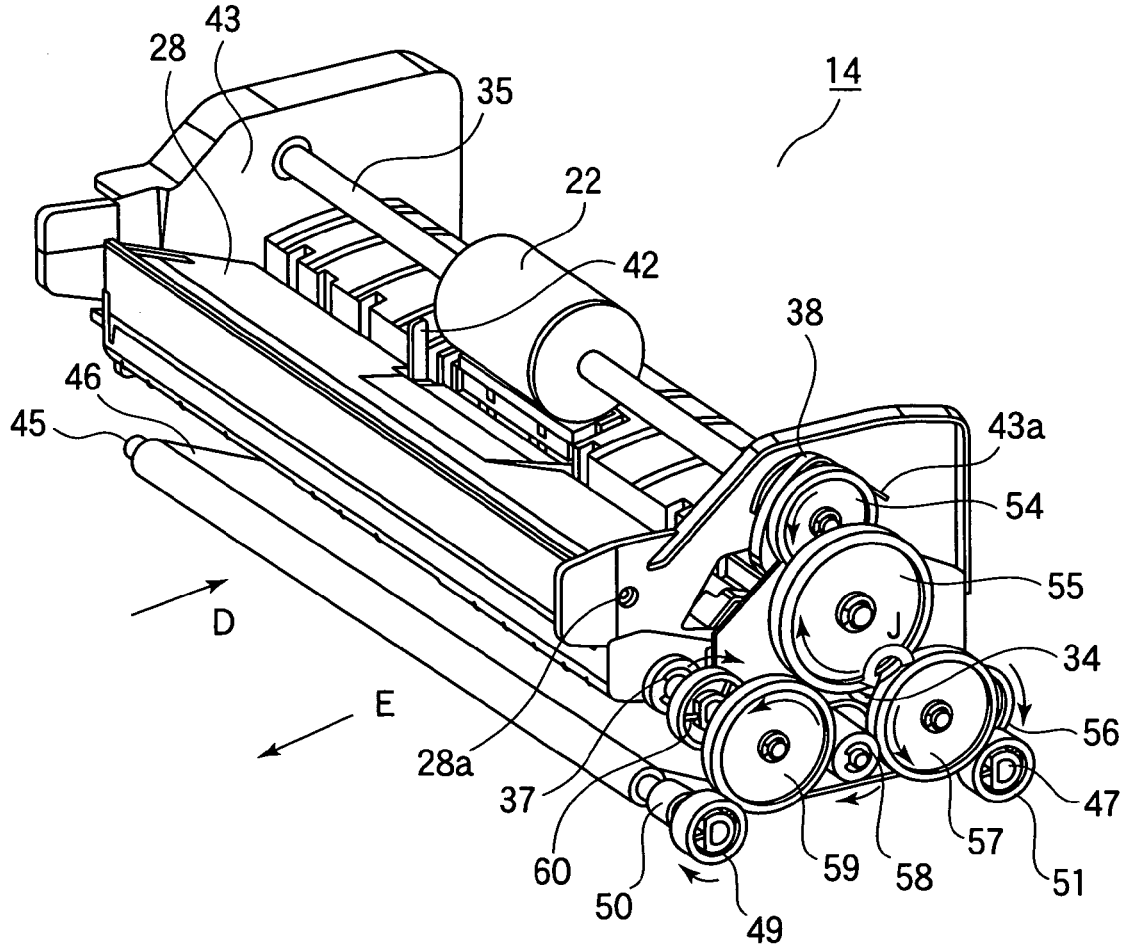
FIG. 17 is a perspective view illustrating the configuration of a driver section of the image reading apparatus of the second embodiment.

FIG. 17 is a perspective view illustrating the configuration of a driver section of the image reading apparatus 13.

Figure 18:
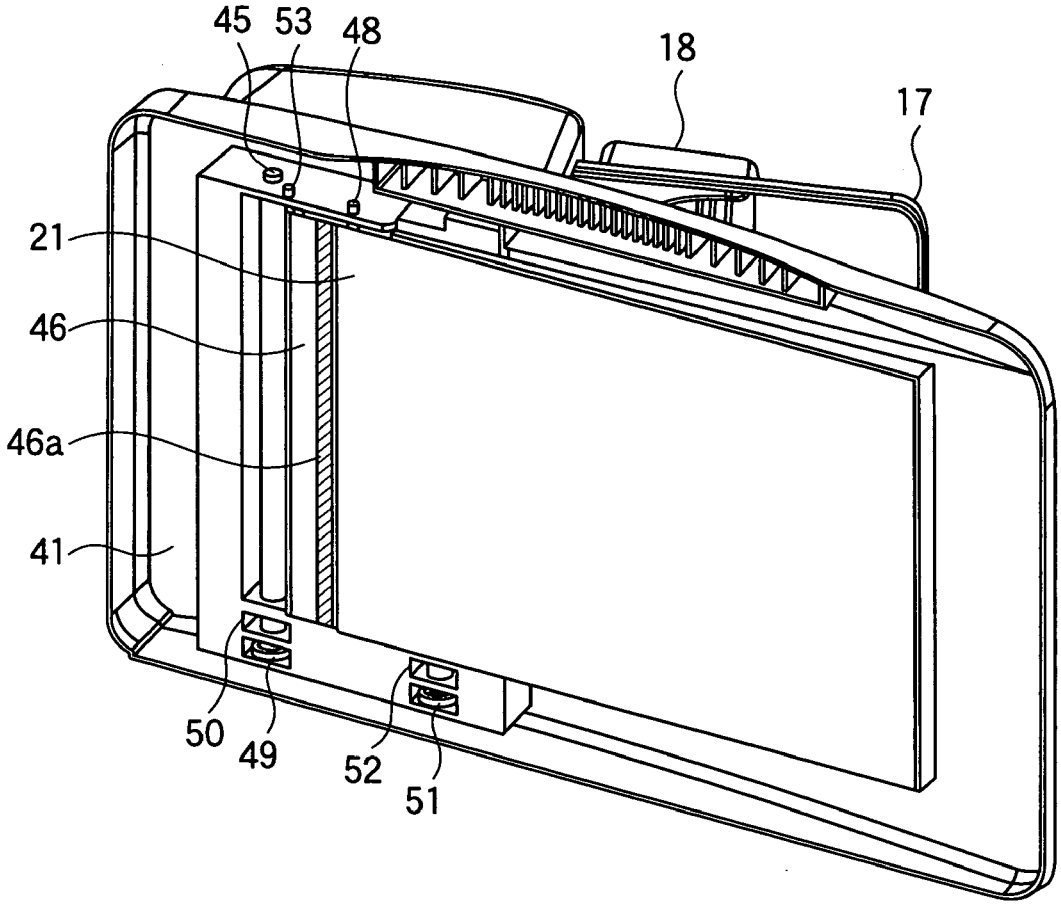
FIG. 18 is a perspective view illustrating the configuration of a document pressing plate.

FIG. 18 is a perspective view illustrating the configuration of a document pressing plate 21.

Figure 19A:
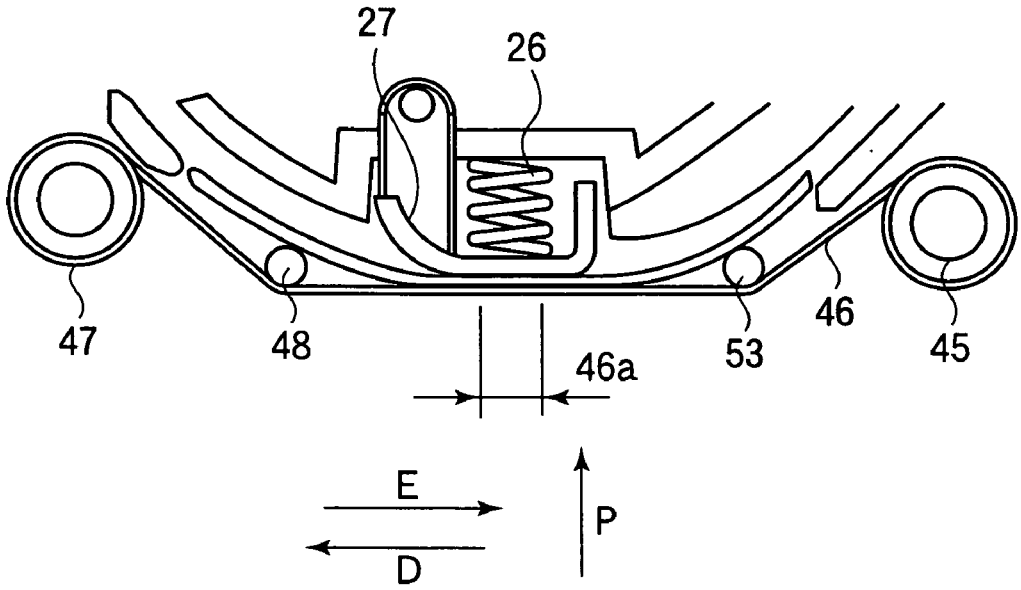
FIG. 19A is a first expanded cross sectional view illustrating the configuration of a pertinent portion of the image reading apparatus in an automatic mode.

FIG. 19A is a first expanded cross sectional view illustrating the configuration of a pertinent portion of the image reading apparatus 13 when a colorless, a transparent area 46*a* of the shutter 46 is at an image reading position 62 (FIG. 16B) in an automatic mode.

Figure 19B:
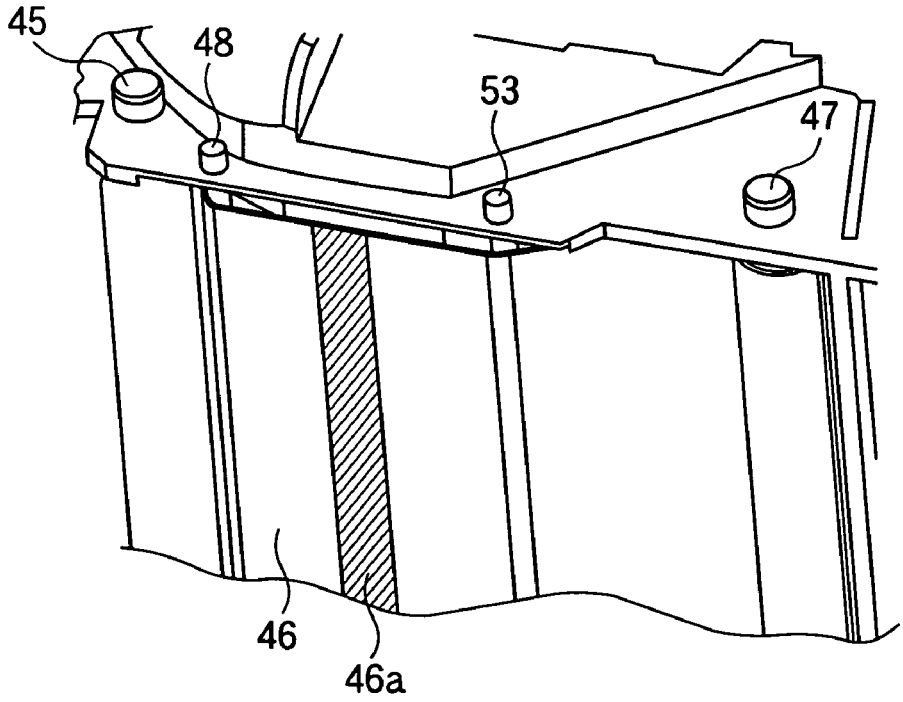
FIG. 19B is a perspective view a shutter of FIG. 19A as seen in a direction shown by arrow P shown in FIG. 19A when it opens a window.

FIG. 19B is a perspective view a shutter of FIG. 19A as seen in a direction shown by arrow P shown in FIG. 19A when it opens a window.

Figure 20:
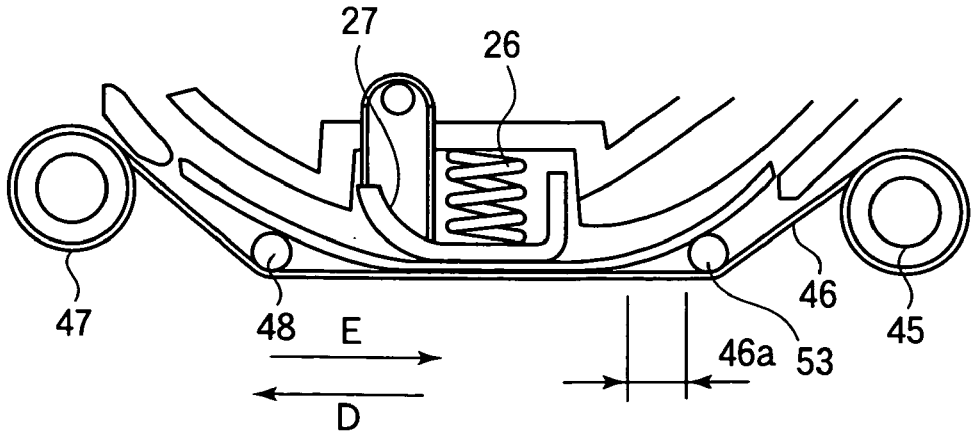
FIG. 20 is a second expanded cross sectional view illustrating the configuration of the pertinent portion of the image reading apparatus in a manual mode.

FIG. 20 is a second expanded cross sectional view illustrating the configuration of the pertinent portion of the image reading apparatus 13 when the transparent area 46*a* of the shutter 46 is away from the image reading position 62 in a manual mode.

The shutter 46 is formed of a flexible material, and is fixed at its longitudinal end portions to drive shafts 45 and 47 rotatably mounted to a base frame 43, respectively. The shutter 46 is wrapped around the drive shafts 45 and 47. Referring to FIG. 16A, the drive shaft 45 is disposed downstream of the paper weight 27 with respect to a direction of travel of the document, and the drive shaft 47 is disposed upstream of the paper weight 27. The paper weight 27 and the drive shafts 45 and 47 extend in directions substantially perpendicular to the direction of travel of the document. Gears 49 and 51 are mounted to the longitudinal end portions of the drive shafts 45 and 47.

The shutter 46 is maintained in tension, and extends horizontally under the paper weight 27 to face the entire lower surface of the paper weight 27. When the drive shafts 45 and 47 rotate, the shutter 46 travels in a direction shown by arrow D or arrow E shown in FIGS. 17, 19A, and 20 depending on the direction of rotation of the drive shafts 45 and 47. The drive shafts 45 and 47 have the same diameter, and the gears 49 and 51 have an equal number of teeth, so that the shutter 46 may advance smoothly relative to the paper weight 27 without non-uniform stress exerted on the shutter 46.

The shutter 46 is formed of a white sheet-like material having sufficient reflectivity and resiliency. The transparent area 46*a* of the sheet-like shutter 46 serves as a "window" through which an image reading section 105 reads the image of a document. The shutter 46 is advanced in a direction shown by arrow D or E (FIGS. 17, 19A, and 20) depending on whether the image reading apparatus 13 operates in the automatic mode or manual mode, thereby causing the transparent area 46*a* of the shutter 46 to horizontally move along the upper surface of a flatbed 20 in FIG. 16A.

In the automatic mode where the document feeding section 14 feeds the document to the image reading position 62 as shown in FIG. 16B, the transparent area 46*a* takes up the image reading position 62 where the transparent area 46*a*, paper weight 27 and the image reading section 105 are aligned with one another as shown in FIG. 16B. It is to be noted that the image reading position 62 is within the image reading area defined on the flatbed 20. The image reading section 105 reads the image of the document moving past the image reading position, the image being read through the a transparent guide 61, the flatbed 20, and the transparent area 46*a*. The document is transported through a narrow gap between the transparent guide 61 and the paper weight 27 past the image reading position 62. A spring 26 urges the paper weight 27 toward the transparent area 46*a*, the paper weight 27 pressing the document against the transparent guide 61 while allowing the document to pass through the gap.

In the manual mode where a user places a document on the flatbed 20, the shutter 46 is moved to a position right to the image reading position 62. In other words, the transparent area 46*a* is no longer between the flatbed 20 and the transparent guide 61 but is behind the document pressing plate 21 as shown in FIG. 18.

Referring to FIGS. 17, 19A, 19B, and 20, rollers 48 and 53 are mounted to the base frame 43, being rotatable about their rotational axes in an idling manner. The rollers 48 and 53 facilitate smooth movement of the shutter 46 in the D and E directions, and prevent damage to and soiling of the shutter 46.

Referring to FIG. 18, torque limiters 50 and 52 are mounted to the drive shafts 45 and 47, respectively. When a torque larger than a predetermined value is exerted on the drive shafts 45 and 47, the toque limiters 50 and 52 allow idle running of the gears 49 and 51 mounted to the shafts 45 and 47, respectively. The predetermined value of torque should be larger than a torque sufficient for moving the shutter 46, and is selected to be, for example, 300 g·cm.

The remaining portion of the configuration is the same as that of the first embodiment and its description is omitted.

{Operation of Image Reading Apparatus}

{Automatic Mode}

The operation of the image reading apparatus 13 of the second embodiment will be described. First, a description will be given of the operation of the image reading apparatus 13 in the automatic mode.

Referring to FIG. 17, when the document is placed on a document-feeding tray 17, the document pushes down a sensor 42 so that the sensor 42 detects the document. Subsequently, a user commands to read the image of the document, and then the drive motor 34 rotates in a direction shown by arrow J. When the document is not present on the document-feeding tray 17, even if the user commands to read the image of the document, the drive motor 34 will not rotate.

The drive motor 34 drives the gears 49, 51, and 54-60 to rotate in directions shown by arrows shown in FIG. 17, respectively. A locking member 38 coupled to a drive shaft 35 rotates in the same direction as the gear 54 until the locking member 38 abuts a rib 43*a* formed on the base frame 43 to stop (FIG. 9). As a result, the locking member 38 disengages from a hopper 28 to unlock the hopper 28.

When the locking member 38 rotates, the drive shafts 45 and 47 rotate in the same direction as the locking member 38, so that the shutter 46 advances in a direction shown by arrow D shown in FIGS. 17, 19A, and 20. When the transparent area 46*a* arrives at the image reading position 62 shown in FIGS. 16B and 18, the shutter 46 has been unwrapped completely, and may not be advanced any further in the same direction. Therefore, the shutter 46 is unable to advance in the D direction, remaining in tension between the drive shafts 45 and 47. Because a load is exerted on the drive shafts 45 and 47, the torque limiters 50 and 52 cause the gears 49 and 51 to rotate in an idling manner, the shutter 46 remaining held taut.

Once the hopper 28 is unlocked, the urging force of a spring 29 causes the hopper 28 to rotate about a shaft 28*a* so that the document is in intimate contact with the feed roller 22. The feed roller 22 feeds the document from the document-feeding tray 17 toward the transport roller 23 on a page-by-page basis. The transport roller 23 further advances the document to the image reading position 62 (FIG. 16B). The paper weight 27 presses the document against the transparent guide 61, so that the image reading section 105 reads the image of the document.

Once the reading of the image of the document has completed, the drive motor 34 temporarily rotates in a direction opposite to the J direction (FIG. 17) under the control of a control program. Thus, the drive shafts 45 and 47 rotate in the opposite directions so that the shutter 46 advances in the E direction shown in FIGS. 17, 19A, and 20. Thus, the transparent area 46*a* is away from the image reading position 62, preventing the image reading section 105 from reading the document.

{Manual Mode}

A description will be given of the operation of the image reading apparatus 13 in the manual mode where the user places a document on the flatbed 20 for reading the image of the document.

When the user places the document on the flatbed 20, the sensor 42 does not detect the document and the sheet-like shutter 46 is closed.

In response to the user's command, the carriage 16 runs on a guide rail 16*a* relative to the document at a constant speed. The image reading section 105 mounted on the carriage 16 moves together with the carriage 16, while reading the image of the document which is at rest on the flatbed 20.

The remaining portion of the configuration operates in the same manner as that of the first embodiment, and its description is omitted.

As described above, the second embodiment employs the sheet-like shutter 46 in place of the shutter 33 of the first embodiment. The shutter 46 moves such that the transparent area 46*a* moves into a gap between the image reading section 105 at the reading position 62 and the transparent guide 61 or out of the gap. The image reading section 105 may be closer to the document when the sheet-like shutter 46 having a small thickness is employed than when the shutter 33 having a large thickness is employed.

Third Embodiment

Elements common to those of the first embodiment have been given the same reference numerals and their description is omitted. The description of the same operations and advantages as the first embodiment is also omitted.

Figure 21A:
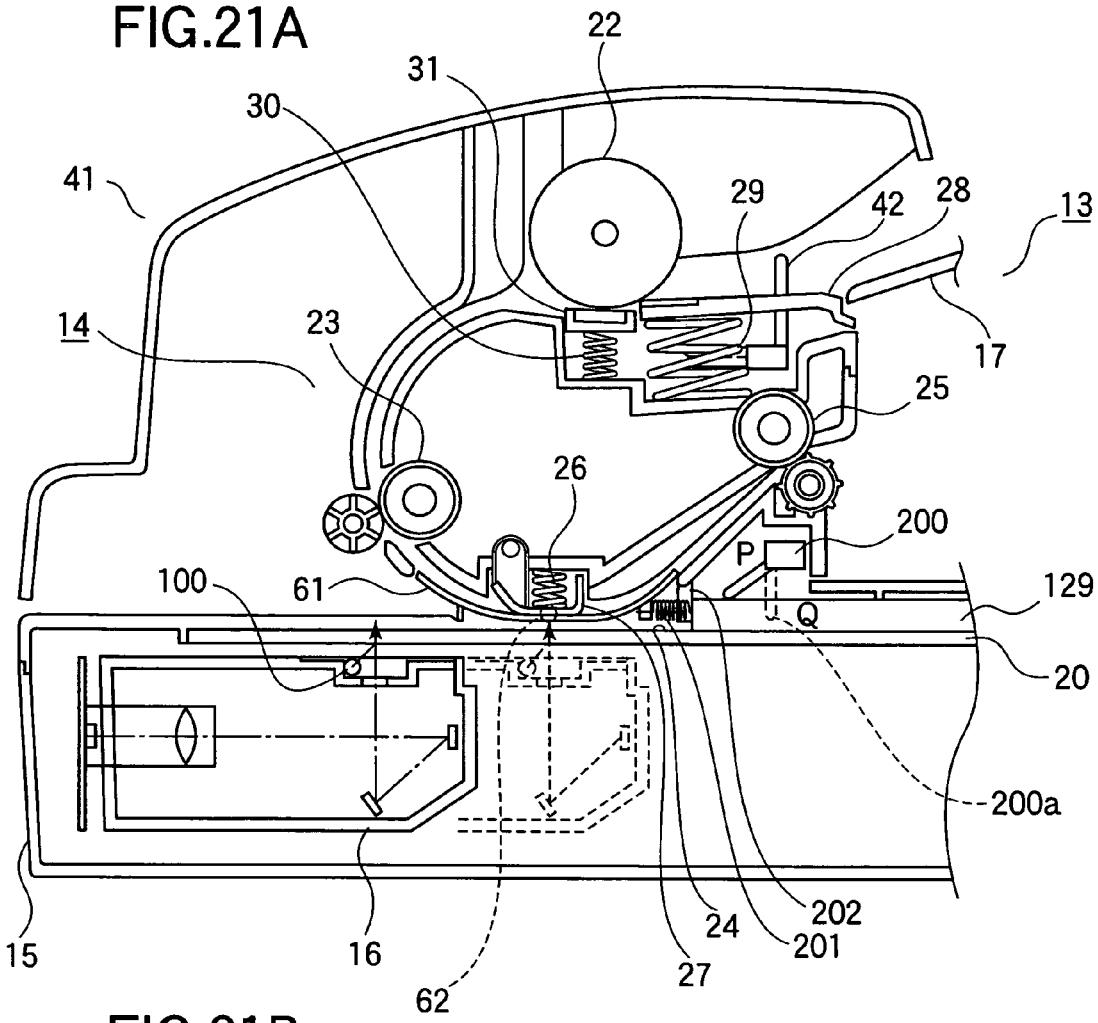
FIG. 21A is a cross-sectional side view of a third embodiment illustrating a pertinent portion of an image reading apparatus in the automatic mode.
Figure 21B:
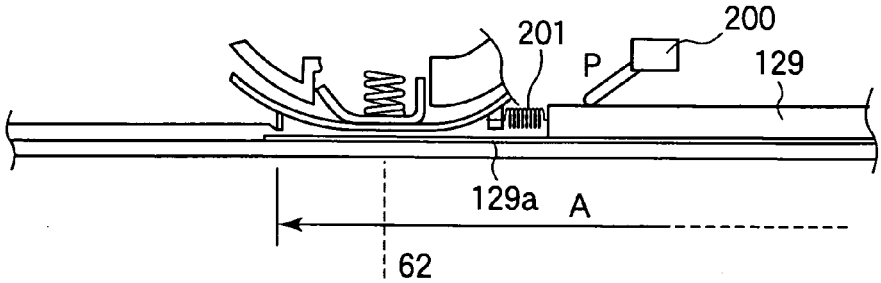
FIG. 21B is a partial expanded view illustrating the position of the shutter in the manual mode.
Figure 21C:
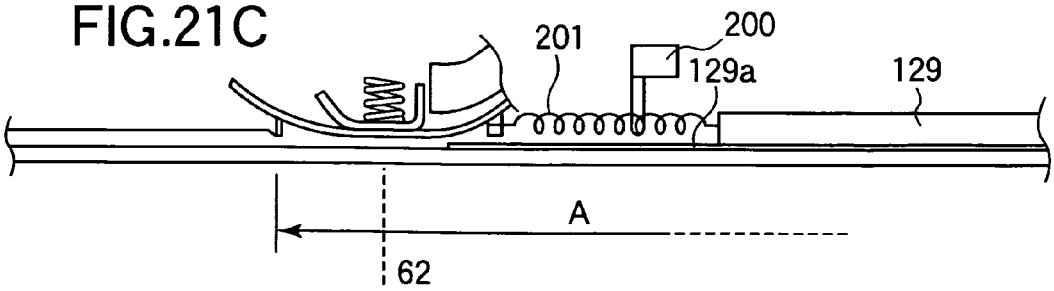
FIG. 21C is a partial expanded view illustrating the position of the shutter in the automatic mode.

FIG. 21A is a cross-sectional side view illustrating a pertinent portion of an image reading apparatus 13 in the automatic mode. FIG. 21B is a partial expanded view illustrating the position of a document pressing plate 129 in the manual mode. FIG. 21C is a partial expanded view illustrating the position of the document pressing plate 129 in the automatic mode.

Referring to FIG. 21A, a flatbed scanner 15 further includes a sensor 200 that detects the position of a document pressing plate 129, a stopper 202 that abuts the document pressing plate 129, and a spring 201 that urges the document pressing plate 129 toward the stopper 202.

The flatbed scanner 15 includes a document supporting plate or a flatbed 20 (e.g., glass plate) on which an image reading area A (FIG. 24) is defined, the document pressing plate 129, and a scanning mechanism or a carriage 16 with an image reading section 105 mounted thereon. The document pressing plate 129 has substantially the same shape as the image reading area A. The document pressing plate 129 is typically rectangular and extends to cover at least the substantially entire image reading area A. The document pressing plate 129 may be larger than the image reading area A.

A reflective white sheet 129*a* is attached to the document pressing plate 129, and extends across the entire image reading area A to press the document against the flatbed 20 in the manual mode. The white sheet 129*a* extends to cover the image reading area A except for a reading position 62 at which the image reading apparatus reads the image of the document in the automatic mode.

The sensor 200 includes a lever 200*a* that engages the document pressing plate 129 to detect the position of the document pressing plate 129. The spring 201 always urges the document pressing plate 129 toward the stopper 202 so that the document pressing plate 129 abuts the stopper 202 in the manual mode. The lever 200*a* at position P causes the sensor 200 to output an ON signal indicative that the document pressing plate 129 abuts the stopper 202 and is at rest. Thus, a controller (not shown) will not allow the image reading apparatus 13 to operate in the automatic mode. Upon receiving the ON signal from the sensor 200, the controller sends a command to the carriage 16 to move to point B shown in FIG. 24 where the image reading section 105 starts reading the image of the document in the manual mode.

The lever 200*a* at position Q (FIG. 21C) causes the sensor 200 to output an OFF signal indicative that the document pressing plate 129 is away from the stopper 202. Thus, a controller (not shown) allows the image reading apparatus 13 to operate in the automatic mode.

Figure 22:
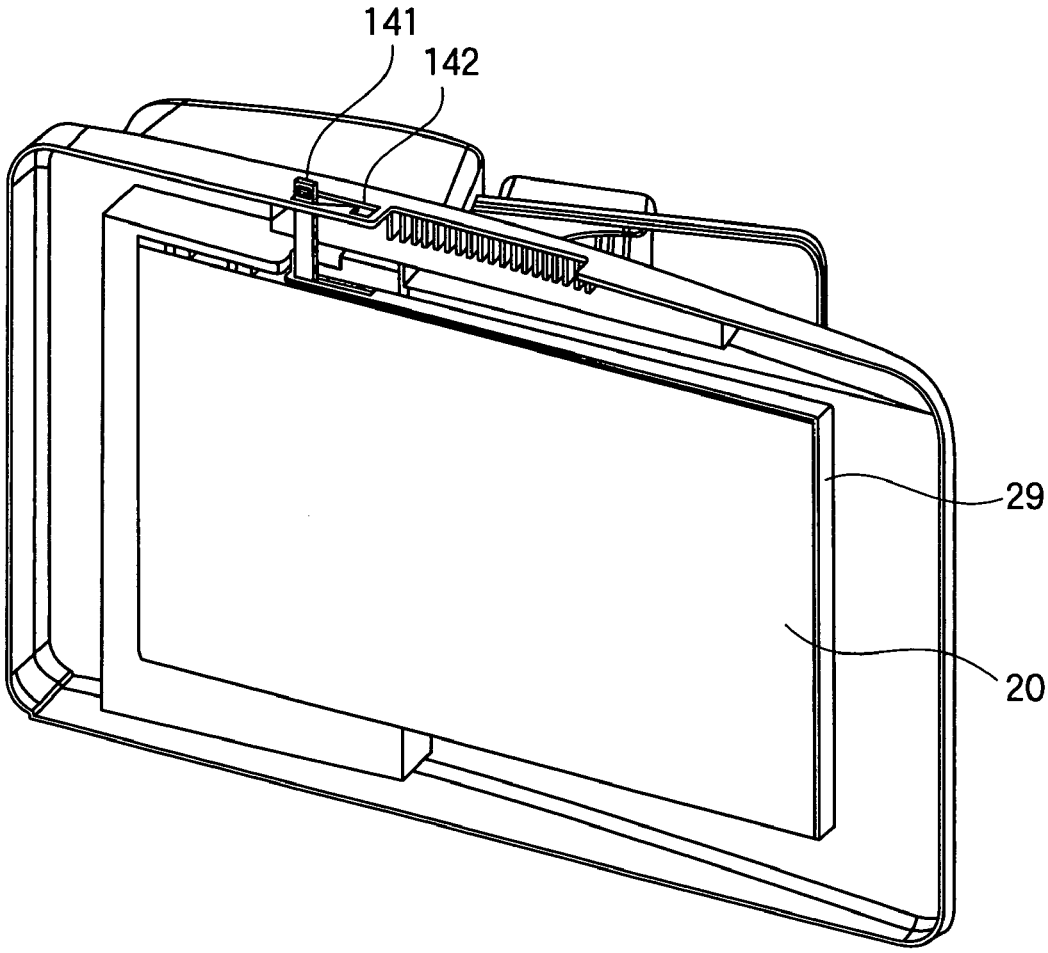
FIG. 22 is a perspective view illustrating the configuration of a document pressing plate for the image reading apparatus in the manual mode.

FIG. 22 is a perspective view illustrating the configuration of the document pressing plate 129 for the image reading apparatus in the manual mode.

Figure 23:
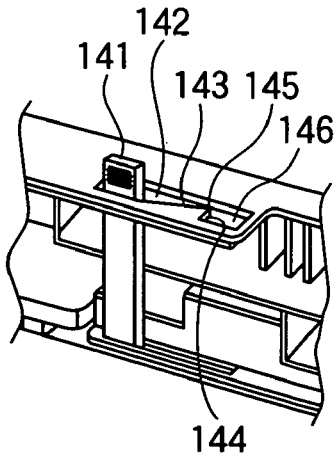
FIG. 23 illustrates the position of an operation lever.

FIG. 23 illustrates the position of an operation lever 141 projecting from the document pressing plate 129.

Figure 24:
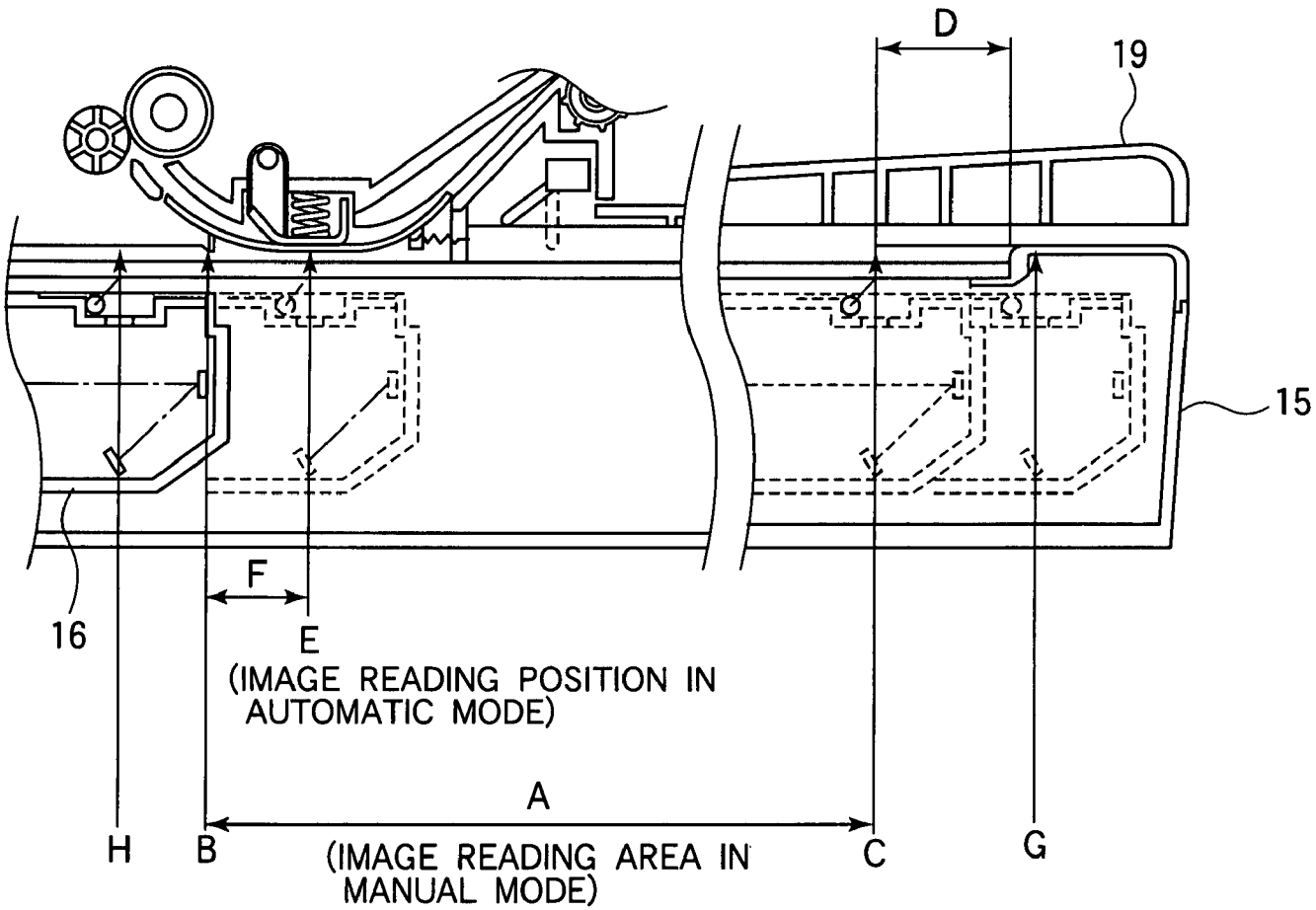
FIG. 24 illustrates various positions of the carriage within the flatbed scanner.

FIG. 24 illustrates various positions of the carriage 16 within the flatbed scanner 15.

As shown in FIGS. 22 and 23, an operation lever 141 extends outwardly of a cover 41 which encloses the flatbed 20 and a document feeding mechanism 14, through an opening 142 formed in a discharge tray 19 (FIG. 24). The discharge tray 19 includes a projection 145 having a beveled surface 143 and a stopper surface 144 that define a part of the opening 142. The operation lever 141 is movable in the opening 142, and the spring 201 urges the document pressing plate 129 toward the stopper 202. Pulling the operation lever 141 in a direction away from the stopper 202 causes the operation lever 141 to climb up the beveled surface 143, and then drop in an opening 146 to engage the stopper surface 144. When the operation lever 141 drops in the opening 146, the document pressing plate 129 is positioned such that the image reading apparatus 13 is ready for operating in the automatic mode. The operation lever 141, opening 142, beveled surface 143, stopper surface 144, projection 145, and opening 146 constitute a selector mechanism.

When the user places a page(s) of document on the hopper 28, the document presses down the sensor 42 (FIG. 21A), which in turn detects the document. In the automatic mode, upon receiving the detection signal of the sensor 42, the carriage 16 moves from position H shown in FIG. 24 to position E where the image reading section 105 reads the image of the document that passes over the image reading position 62. It is to be noted that the image reading position 62 is within the image reading area A defined on the flatbed 20.

In the manual mode, the user operates the operation lever 141 to disengage the operation lever 141 from the stopper surface 144 so that the spring 201 pulls the document pressing plate 129 to the stopper 201.

Thus, the document pressing plate 129 remains in abutting engagement with the stopper 202. Thus, the lever 200*a* is at position P (FIG. 21A, FIG. 21B) and the reflective white sheet 129*a* is between the image reading position 62 and the image reading section 105. In response to the output of the sensor 200, the controller (not shown) causes the carriage 16 to move from position H to position B where the image reading apparatus 13 waits for the user's command to read the document on the flatbed 20.

After the user places the document in the image reading area A defined on the flatbed 20, the controller controls the carriage 16 to move from point B to point C across the image reading area A. After reaching point C, the carriage 16 further advances to point G while slowing down. Thereafter, the controller controls the carriage 16 to return to the home position H. This completes reading an image of a page of the document.

Table 1 shows the relation among the outputs of the sensors 200 and 203 and the operation for reading an image of a document.

TABLE 1

| | | | | |
|---|---|---|---|---|
| SENSOR 200 | OFF | OFF | ON | ON |
| SENSOR 203 | ON | OFF | ON | OFF |
| IMAGE READING | AUTOMATIC MODE | NO IMAGE READING | MANUAL MODE | MANUAL MODE |

When the sensor 200 outputs an ON signal, the image reading apparatus is ready to perform the image reading in the manual mode. When the sensor 200 outputs an OFF signal and the sensor 203 outputs an ON signal, the image reading apparatus is ready to perform the image reading in the automatic mode.

In the third embodiment, the image reading position 62 (i.e., position E shown in FIG. 24) in the automatic mode is defined within the image reading area A in the manual mode. This results in a smaller overall size of the scanner. The position of the document pressing plate 21 may be manually set, providing uniform reflection of light by means of a simple mechanism.

The invention being thus described, it will be obvious that the same may be varied in many ways. Such variations are not to be regarded as a departure from the scope of the invention, and all such modifications as would be obvious to one skilled in the art intended to be included within the scope of the following claims.

What is claimed is:

1. An image reading apparatus, comprising:

an image reading section that reads an image of a document;

a scanning mechanism that causes the image reading section to move relative to the document when the document is at rest;

a document feeding mechanism that causes the document to move relative to the image reading section when the image reading section is at rest; and a shutter movable between a first position where the shutter remains at rest and opens, allowing the image reading section to read the image of the document when the document moves relative to the image reading section at rest, and a second position where the shutter remains at rest and closes, allowing the image reading section to read the image of the document when the image reading section moves relative to the document at rest.

2. The image reading apparatus according to claim 1, wherein the document feeding mechanism includes a drive motor, and wherein the shutter moves either to the first position or to the second position in an interlocked relation with the drive motor.

3. The image reading apparatus according to claim 2, wherein the shutter is formed of a plate-like material.

4. The image reading apparatus according to claim 2, wherein the shutter is formed of a flexible, sheet-like material.

5. The image reading apparatus according to claim 1, wherein the scanning mechanism that causes the image reading section to move within an image reading area relative to the document when the document is at rest within the image reading area; and wherein the image reading section is positioned within the image reading area when the document moves relative to the image reading section at rest.

6. The image reading apparatus according to claim 5, further comprising a document supporting member on which the image reading area is defined; and wherein the shutter extends to at least cover the image reading area and presses the document against the document supporting member;

wherein when the image reading apparatus operates in a mode in which the document is at rest and the image reading section moves relative to the document to read the image of the document, the document is placed within the image reading area.

7. The image reading apparatus according to claim 6, wherein the mode is a first mode, wherein the image reading apparatus further comprises a selector mechanism that selects whether the image reading apparatus should operate in the first mode or in a second mode in which the document moves relative to the image reading section at rest and the image reading section reads the image of the document through the opening.

8. The image reading apparatus according to claim 6, wherein the document pressing plate moves either to the first position or to the second position in an interlocked relation with the drive motor.

9. The image reading apparatus according to claim 1, wherein when the image reading apparatus operates in a first mode in which the document is at rest and the image reading section moves relative to the document to read the image of the document, the shutter is at the first position to close a window through which the image reading section reads the image of the document;

wherein when the image reading apparatus operates in a second mode in which the document moves relative to the image reading section at rest and the image reading section reads the image of the document through the opening, the shutter is at the second position to open the window through which the image reading section reads the image of the document.

10. An image forming system that incorporates the image reading apparatus according to claim 1 and an image forming apparatus.

* * * * *